US007559365B2

(12) United States Patent
Watson et al.

(10) Patent No.: US 7,559,365 B2
(45) Date of Patent: Jul. 14, 2009

(54) COLLAPSIBLE EXPANSION CONE

(75) Inventors: Brock Wayne Watson, Carrollton, TX (US); David Paul Brisco, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 324 days.

(21) Appl. No.: 10/495,347

(22) PCT Filed: Nov. 12, 2002

(86) PCT No.: PCT/US02/36157

§ 371 (c)(1),
(2), (4) Date: Nov. 12, 2004

(87) PCT Pub. No.: WO03/042486

PCT Pub. Date: May 22, 2003

(65) Prior Publication Data

US 2005/0056434 A1 Mar. 17, 2005

Related U.S. Application Data

(60) Provisional application No. 60/338,996, filed on Nov. 12, 2001, provisional application No. 60/339,013, filed on Nov. 12, 2001, provisional application No. 60/363,829, filed on Mar. 13, 2002, provisional application No. 60/387,961, filed on Jun. 12, 2002.

(51) Int. Cl.
*E21B 43/10* (2006.01)

(52) U.S. Cl. ..... 166/207; 166/384

(58) Field of Classification Search ..... 166/206, 166/207, 384, 380

See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,358,818 | A | 11/1920 | Bering |
| 1,494,128 | A | 5/1924 | Primrose |

(Continued)

FOREIGN PATENT DOCUMENTS

AU 767364 2/2004

(Continued)

OTHER PUBLICATIONS

Tribology Transactions, "Friction-Reducing Surface-Texturing in Reciprocating Automotive Components" Aviram Ronen, and Izhak Etsion (2001).

(Continued)

*Primary Examiner*—Kenneth Thompson
(74) *Attorney, Agent, or Firm*—Conley Rose, P.C.

(57) ABSTRACT

An apparatus for radially expanding and plastically deforming an expandable tubular member includes a collapsible expansion cone.

46 Claims, 20 Drawing Sheets

U.S. PATENT DOCUMENTS

| | | | | |
|---|---|---|---|---|
| 1,589,781 | A | | 6/1926 | Anderson |
| 1,590,357 | A | | 6/1926 | Feisthamel |
| 1,597,212 | A | | 8/1926 | Spengler |
| 1,613,461 | A | | 1/1927 | Johnson |
| 1,739,932 | A | | 12/1929 | Ventresca |
| 1,756,531 | A | | 4/1930 | Aldeen et al. |
| 1,880,218 | A | | 10/1932 | Simmons |
| 1,952,652 | A | | 3/1934 | Brannon |
| 1,981,525 | A | | 11/1934 | Price |
| 2,046,870 | A | | 7/1936 | Clasen et al. |
| 2,087,185 | A | | 7/1937 | Dillom |
| 2,110,913 | A | | 3/1938 | Lowrey |
| 2,122,757 | A | | 7/1938 | Scott |
| 2,134,311 | A | | 10/1938 | Minor et al. |
| 2,145,168 | A | | 1/1939 | Flagg |
| 2,160,263 | A | | 5/1939 | Fletcher |
| 2,187,275 | A | | 1/1940 | McLennan |
| 2,204,586 | A | | 6/1940 | Grau |
| 2,211,173 | A | | 8/1940 | Shaffer |
| 2,214,226 | A | | 9/1940 | English |
| 2,226,804 | A | | 12/1940 | Carroll |
| 2,246,038 | A | | 6/1941 | Graham |
| 2,273,017 | A | | 2/1942 | Boynton |
| 2,301,495 | A | | 11/1942 | Abegg |
| 2,305,282 | A | | 12/1942 | Taylor, Jr. et al. |
| 2,371,840 | A | | 3/1945 | Otis |
| 2,383,214 | A | | 8/1945 | Prout |
| 2,407,552 | A | | 9/1946 | Hoesel |
| 2,447,629 | A | | 8/1948 | Beissinger et al. |
| 2,481,637 | A | | 9/1949 | Yancey |
| 2,500,276 | A | | 3/1950 | Church |
| 2,546,295 | A | | 3/1951 | Boice |
| 2,583,316 | A | | 1/1952 | Bannister |
| 2,609,258 | A | | 11/1952 | Taylor, Jr. et al. |
| 2,627,891 | A | | 2/1953 | Clark |
| 2,647,847 | A | | 8/1953 | Black et al. |
| 2,664,952 | A | | 1/1954 | Losey |
| 2,691,418 | A | | 10/1954 | Connolly |
| 2,695,449 | A | | 11/1954 | Chauvin |
| 2,723,721 | A | | 11/1955 | Corsette |
| 2,734,580 | A | | 2/1956 | Layne |
| 2,735,485 | A | | 2/1956 | Metcalf, Jr. |
| 2,796,134 | A | | 6/1957 | Binkley |
| 2,812,025 | A | | 11/1957 | Teague et al. |
| 2,877,822 | A | | 3/1959 | Buck |
| 2,907,589 | A | | 10/1959 | Knox |
| 2,919,741 | A | | 1/1960 | Strock et al. |
| 2,929,741 | A | | 1/1960 | Strock et al. |
| 3,015,362 | A | | 1/1962 | Moosman |
| 3,015,500 | A | | 1/1962 | Barnett |
| 3,018,547 | A | | 1/1962 | Marskell |
| 3,039,530 | A | | 6/1962 | Condra |
| 3,067,801 | A | | 12/1962 | Sortor |
| 3,067,819 | A | | 12/1962 | Gore |
| 3,068,563 | A | | 12/1962 | Reverman |
| 3,104,703 | A | | 9/1963 | Rike et al. |
| 3,111,991 | A | | 11/1963 | O'Neal |
| 3,167,122 | A | | 1/1965 | Lang |
| 3,175,618 | A | | 3/1965 | Lang et al. |
| 3,179,168 | A | | 4/1965 | Vincent |
| 3,188,816 | A | | 6/1965 | Koch |
| 3,191,677 | A | | 6/1965 | Kinley |
| 3,191,680 | A | | 6/1965 | Vincent |
| 3,203,451 | A | | 8/1965 | Vincent |
| 3,203,483 | A | * | 8/1965 | Vincent ..... 166/207 |
| 3,209,546 | A | | 10/1965 | Lawton |
| 3,210,102 | A | | 10/1965 | Joslin |
| 3,233,315 | A | | 2/1966 | Levake |
| 3,245,471 | A | | 4/1966 | Howard |
| 3,270,817 | A | | 9/1966 | Papaila |
| 3,297,092 | A | | 1/1967 | Jennings |
| 3,326,293 | A | | 6/1967 | Skipper |
| 3,343,252 | A | | 9/1967 | Reesor |
| 3,353,599 | A | | 11/1967 | Swift |
| 3,354,955 | A | | 11/1967 | Berry |
| 3,358,760 | A | | 12/1967 | Blagg |
| 3,358,769 | A | | 12/1967 | Berry |
| 3,364,993 | A | | 1/1968 | Skipper |
| 3,371,717 | A | | 3/1968 | Chenoweth |
| 3,397,745 | A | | 8/1968 | Owens et al. |
| 3,412,565 | A | | 11/1968 | Lindsey et al. |
| 3,419,080 | A | | 12/1968 | Lebourg |
| 3,422,902 | A | | 1/1969 | Bouchillon |
| 3,424,244 | A | | 1/1969 | Kinley |
| 3,427,707 | A | | 2/1969 | Nowosadko |
| 3,463,228 | A | | 8/1969 | Hearn |
| 3,477,506 | A | | 11/1969 | Malone |
| 3,489,220 | A | | 1/1970 | Kinley |
| 3,489,437 | A | | 1/1970 | Duret |
| 3,498,376 | A | | 3/1970 | Sizer et al. |
| 3,504,515 | A | | 4/1970 | Reardon |
| 3,508,771 | A | | 4/1970 | Duret |
| 3,520,049 | A | | 7/1970 | Lysenko et al. |
| 3,528,498 | A | | 9/1970 | Carothers |
| 3,532,174 | A | | 10/1970 | Diamantides et al. |
| 3,568,773 | A | | 3/1971 | Chancellor |
| 3,572,777 | A | | 3/1971 | Blose et al. |
| 3,574,357 | A | | 4/1971 | Alexandru et al. |
| 3,578,081 | A | | 5/1971 | Bodine |
| 3,579,805 | A | | 5/1971 | Kast |
| 3,581,817 | A | | 6/1971 | Kammerer, Jr. |
| 3,605,887 | A | | 9/1971 | Lambie |
| 3,631,926 | A | | 1/1972 | Young |
| 3,665,591 | A | | 5/1972 | Kowal |
| 3,667,547 | A | | 6/1972 | Ahlstone |
| 3,669,190 | A | | 6/1972 | Sizer et al. |
| 3,678,727 | A | | 7/1972 | Jackson |
| 3,682,256 | A | | 8/1972 | Stuart |
| 3,687,196 | A | | 8/1972 | Mullins |
| 3,691,624 | A | | 9/1972 | Kinley |
| 3,693,717 | A | | 9/1972 | Wuenschel |
| 3,704,730 | A | | 12/1972 | Witzig |
| 3,709,306 | A | | 1/1973 | Curington |
| 3,711,123 | A | | 1/1973 | Arnold |
| 3,712,376 | A | | 1/1973 | Owen et al. |
| 3,746,068 | A | | 7/1973 | Deckert et al. |
| 3,746,091 | A | | 7/1973 | Owen et al. |
| 3,746,092 | A | | 7/1973 | Land |
| 3,764,168 | A | | 10/1973 | Kisling, III et al. |
| 3,776,307 | A | | 12/1973 | Young |
| 3,779,025 | A | | 12/1973 | Godley et al. |
| 3,780,562 | A | | 12/1973 | Kinley |
| 3,781,966 | A | | 1/1974 | Lieberman |
| 3,785,193 | A | | 1/1974 | Kinely et al. |
| 3,797,259 | A | | 3/1974 | Kammerer, Jr. |
| 3,805,567 | A | | 4/1974 | Agius-Sincero |
| 3,812,912 | A | | 5/1974 | Wuenschel |
| 3,818,734 | A | | 6/1974 | Bateman |
| 3,826,124 | A | | 7/1974 | Baksay |
| 3,830,294 | A | | 8/1974 | Swanson |
| 3,830,295 | A | | 8/1974 | Crowe |
| 3,834,742 | A | | 9/1974 | McPhillips |
| 3,848,668 | A | | 11/1974 | Sizer et al. |
| 3,866,954 | A | | 2/1975 | Slator et al. |
| 3,874,446 | A | | 4/1975 | Crowe |
| 3,885,298 | A | | 5/1975 | Pogonowski |
| 3,887,006 | A | | 6/1975 | Pitts |
| 3,893,718 | A | | 7/1975 | Powell |
| 3,898,163 | A | | 8/1975 | Mott |
| 3,915,478 | A | | 10/1975 | Al et al. |
| 3,915,763 | A | | 10/1975 | Jennings et al. |
| 3,935,910 | A | | 2/1976 | Gaudy et al. |
| 3,942,824 | A | | 3/1976 | Sable |
| 3,945,444 | A | | 3/1976 | Knudson |

3,948,321 A 4/1976 Owen et al.
3,963,076 A 6/1976 Winslow
3,970,336 A 7/1976 O'Sickey et al.
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,011,652 A 3/1977 Black
4,018,634 A 4/1977 Fenci
4,019,579 A 4/1977 Thuse
4,026,583 A 5/1977 Gottlieb
4,047,568 A 9/1977 Aulenbacher
4,053,247 A 10/1977 Marsh, Jr.
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchinson et al.
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,212,186 A * 7/1980 Blattler ..... 72/393
4,226,449 A 10/1980 Cole
4,253,687 A 3/1981 Maples
4,257,155 A 3/1981 Hunter
4,262,518 A * 4/1981 Creger et al. ..... 72/393
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Lanriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,762,344 A 8/1988 Perkins et al.
4,776,394 A 10/1988 Lynde et al.

4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,249,628 A 10/1993 Surjaatmadja
5,253,713 A 10/1993 Gregg et al.
RE34,467 E 12/1993 Reeves
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn 5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,009,611 A 1/2000 Adams
6,012,521 A 1/2000 Zunkel et al.
6,012,522 A 1/2000 Donnelly et al.
6,012,523 A * 1/2000 Campbell et al. ..... 166/277
6,012,874 A 1/2000 Groneck et al.
6,013,724 A 1/2000 Mizutani et al.
6,015,012 A 1/2000 Reddick
6,017,168 A 1/2000 Fraser et al.
6,021,850 A 2/2000 Woo et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Shultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.

6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 * 12/2002 Cook et al. ..... 166/380
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,029 B2 * 3/2004 Metcalfe et al. ..... 166/378
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrack
6,935,430 B2 8/2005 Harrell et al.
6,966,370 B2 11/2005 Cook et al.
6,968,618 B2 11/2005 Cook et al.
6,976,539 B2 12/2005 Metcalfe et al.
6,976,541 B2 12/2005 Brisco et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.

7,044,218 B2 5/2006 Cook et al.
7,044,221 B2 5/2006 Cook et al.
7,048,062 B2 5/2006 Ring et al.
7,048,067 B1 5/2006 Cook et al.
7,055,608 B2 6/2006 Cook et al.
7,063,142 B2 6/2006 Cook et al.
7,063,149 B2 6/2006 Simpson et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,685 B2 9/2006 Cook et al.
7,114,559 B2 * 10/2006 Sonnier et al. ..... 166/206
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,164,964 B2 1/2007 Stacklies
7,185,710 B2 3/2007 Cook et al.
7,191,841 B2 3/2007 Sivley, IV
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
7,416,027 B2 * 8/2008 Ring et al. ..... 166/380
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045646 A1 3/2004 Kuehn
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0195826 A1 10/2004 Goto
2004/0216506 A1 11/2004 Simpson et al.
2004/0216873 A1 11/2004 Frost, Jr. et al.
2004/0221996 A1 11/2004 Burge
2004/0231839 A1 11/2004 Ellington et al.
2004/0231843 A1 11/2004 Simpson et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Ring et al.
2005/0056434 A1 3/2005 Watson et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0172473 A1 8/2005 Cook et al.
2005/0173108 A1 8/2005 Cook et al.
2005/0183863 A1 8/2005 Cook et al.
2005/0205253 A1 9/2005 Cook et al.
2005/0217768 A1 10/2005 Asahi et al.

| | | | |
|---|---|---|---|
| 2005/0217865 | A1 | 10/2005 | Ring et al. |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Waddell |
| 2005/0236159 | A1 | 10/2005 | Costa et al. |
| 2005/0236163 | A1 | 10/2005 | Cook et al. |
| 2005/0244578 | A1 | 11/2005 | Van Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0027371 | A1 | 2/2006 | Gorrara |
| 2006/0032640 | A1 | 2/2006 | Costa et al. |
| 2006/0048948 | A1 | 3/2006 | Noel |
| 2006/0054330 | A1 | 3/2006 | Ring et al. |
| 2006/0065403 | A1 | 3/2006 | Watson et al. |
| 2006/0065406 | A1 | 3/2006 | Shuster et al. |
| 2006/0096762 | A1 | 5/2006 | Brisco |
| 2006/0102360 | A1 | 5/2006 | Brisco et al. |
| 2006/0112768 | A1 | 6/2006 | Shuster et al. |
| 2006/0113086 | A1 | 6/2006 | Costa et al. |
| 2006/0266527 | A1 | 11/2006 | Brisco et al. |
| 2006/0272826 | A1 | 12/2006 | Shuster et al. |
| 2007/0131431 | A1 | 6/2007 | Shuster et al. |
| 2007/0154270 | A1 | 7/2007 | Waddell et al. |

FOREIGN PATENT DOCUMENTS

| | | | |
|---|---|---|---|
| AU | 773168 | | 5/2004 |
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001294802 | | 10/2005 |
| AU | 2001283026 | | 7/2006 |
| AU | 2002239857 | | 8/2006 |
| AU | 2001292695 | | 10/2006 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2419806 | | 4/2002 |
| CA | 2453034 | | 1/2003 |
| CA | 2234386 | | 3/2003 |
| CA | 2466685 | | 3/2004 |
| CA | 2414449 | | 9/2006 |
| CA | 2249139 | | 1/2007 |
| CA | 2289811 | | 1/2007 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 620289 | A1 | 10/1994 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1106778 | A1 | 6/2001 |
| EP | 1141515 | A | 10/2001 |
| EP | 1152119 | A2 | 11/2001 |
| EP | 1152120 | A2 | 11/2001 |
| EP | 1152120 | A3 | 11/2001 |
| EP | 1235972 | A | 9/2002 |
| EP | 1306519 | A2 | 5/2003 |
| EP | 1505251 | A2 | 2/2005 |
| EP | 1555386 | A1 | 7/2005 |
| EP | 1505251 | A3 | 2/2007 |
| FR | 1325596 | | 6/1962 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2124275 | A | 2/1984 |
| GB | 2125876 | A | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2275705 | A | 9/1994 |
| GB | 2279383 | | 1/1995 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2331103 | A | 5/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |

| | | | |
|---|---|---|---|
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2355738 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396639 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404402 | A | 2/2005 |

| | | | |
|---|---|---|---|
| GB | 2404676 | A | 2/2005 |
| GB | 2404677 | A | 2/2005 |
| GB | 2404680 | A | 2/2005 |
| GB | 2384807 | C | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2 403970 | B | 8/2005 |
| GB | 2398326 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2421257 | B | 8/2006 |
| GB | 2421258 | B | 8/2006 |
| GB | 2422859 | A | 8/2006 |
| GB | 2422860 | A | 8/2006 |
| GB | 2423317 | | 8/2006 |
| GB | 2404676 | B | 9/2006 |
| GB | 2414493 | B | 9/2006 |
| GB | 2424077 | A | 9/2006 |
| GB | 2429482 | A | 2/2007 |
| GB | 2410280 | B | 4/2007 |
| GB | 2412178 | B | 5/2007 |
| GB | 2415215 | B | 5/2007 |
| GB | 2408277 | A | 5/2008 |
| ID | P01.012.197/2005 | | 1/2005 |
| ID | 09.044.392/2005 | | 9/2005 |
| ID | 044.392/2005 | | 9/2005 |
| ID | 09.046.2804/2006 | | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |

| | | | |
|---|---|---|---|
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO 93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO 96/10710 | | 11/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO 01/18354 | A1 | 3/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO 02/38343 | A2 | 5/2002 |
| WO | WO02/40825 | A1 | 5/2002 |
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |

| | | | |
|---|---|---|---|
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO 03/093624 | | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO 2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO 2004/027201 | A2 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/089608 | A3 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024141 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020810 | A3 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2006/079072 | A2 | 7/2006 |
| WO | WO2006/088743 | A2 | 8/2006 |
| WO | WO 2006/096762 | A1 | 9/2006 |
| WO | WO2006/102171 | A2 | 9/2006 |
| WO | WO2006/102556 | A2 | 9/2006 |

OTHER PUBLICATIONS

Michigan Metrology "3D Surface Finish Roughness Texture Wear WYKO Veeco" C.A. Brown, PHD; Charles, W.A. Johnsen, S. Chester.

International Search Report, Application PCT/IL00/00245, Sep. 18, 2000.

International Search Report, Application PCT/US00/18635, Nov. 24, 2000.

International Search Report, Application PCT/US00/27645, Dec. 29, 2000.

International Search Report, Application PCT/US00/30022, Mar. 27, 2001.

International Search Report, Application PCT/US01/04753, Jul. 3, 2001.

International Search Report, Application PCT/US01/19014, Nov. 23, 2001.

International Search Report, Application PCT/US01/23815, Nov. 16, 2001.

International Search Report, Application PCT/US01/28960, Jan. 22, 2002.

International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25727; Feb. 19, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/39418, Mar. 24, 2003.
International Search Report, Application PCT/US03/10144; Oct. 31, 2003.
International Search Report, Application PCT/US03/11765; Nov. 13, 2003.
International Search Report, Application PCT/US03/15020; Jul. 30, 2003.
International Search Report, Application PCT/US03/20694; Nov. 12, 2003.
International Search Report, Application PCT/US03/24779; Mar. 3, 2004.
International Search Report, Application PCT/US03/25715; Apr. 9, 2004.
International Search Report, Application PCT/US03/25667; Feb. 26, 2004.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. GB 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Search Report to Application No. GB 0220872.6, Dec. 5, 2002.
Search Report to Application GB 0220872.6, Mar. 13, 2003No.
Search Report to Application No. GB 0225505.7, Mar. 5, 2003.
Search and Examination Report to Application No. GB 0225505.7, Jul. 1, 2003.
Examination Report to Application No. GB 0300085.8, Nov. 28, 2003.
Examination Report to Application No. GB 030086.6, Dec. 1, 2003.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.

Search and Examination Report to Application No. GB 0310836.2, Jun. 12, 2003.
Examination Report to Application No. GB 0310836.2, Aug. 7, 2003.
Search and Examination Report to Application No. GB 0313406.1, Sep. 3, 2003.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application No. Norway 1999 5593, Aug. 20, 2002.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog: "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
International Examination Report, Application PCT/US02/24399, Aug. 6, 2004.
International Search Report, Application PCT/US02/25608; May 24, 2004.
Examination Report, Application PCT/US02/25727; Jul. 7, 2004.
International Search Report, Application PCT/US02/36267; May 21, 2004.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
Examination Report, Application PCT/US03/10144; Jul. 7, 2004.
International Search Report, Application PCT/US03/13787; May 28, 2004.
International Search Report, Application PCT/US03/14153; May 28, 2004.
International Search Report, Application PCT/US03/19993; May 24, 2004.
International Search Report, Application PCT/US03/20870; May 24, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25742; May 27, 2004.
International Search Report, Application PCT/US03/29460; May 25, 2004.

International Search Report, Application PCT/US03/29859; May 21, 2004.
International Examination Report, Application PCT/US03/29859, Aug. 16, 2004.
International Search Report, Application PCT/US03/38550; Jun. 15, 2004.
Examination Report to Application No. GB 0219757.2, May 10, 2004.
Examination Report to Application No. GB 0314846.7, Jul. 15, 2004.
Search and Examination Report to Application No. GB 0308294.8, Jul. 14, 2003.
Search and Examination Report to Application No. GB 0308299.7, Jun. 14, 2003.
Search and Examination Report to Application No. GB 0308303.7, Jul. 14, 2003.
Examination Report to Application No. GB 0311596.1, May 18, 2004.
Examination Report to Application No. GB 0320747.9, May 25, 2004.
Search and Examination Report to Application No. GB 0403891.5, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25727; May 17, 2004.
Written Opinion to Application No. PCT/US02/39418; Jun. 9, 2004.
Written Opinion to Application No. PCT/US03/11765 May 11, 2004.
Written Opinion to Application No. PCT/US03/14153 Sep. 9, 2004.
Written Opinion to Application No. PCT/US03/18530 Sep. 13, 2004.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/11765; Dec. 10, 2004.
International Examination Report, Application PCT/US03/11765;; Jan. 25, 2005.
International Search Report, Application PCT/US03/25742; Dec. 20, 2004.
International Examination Report, Application PCT/US03/29460; Dec. 8, 2004.
Examination Report to Application GB 0220872.6, Oct. 29, 2004.
Examination Report to Application No. GB 0225505.7, Oct. 27, 2004.
Examination Report to Application No. GB 0225505.7 Feb. 15, 2005.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Examination Report to Application No. GB 0406258.4; Jan. 12, 2005.
Search Report to Application No. GB 0415835.8, Dec. 2, 2004.
Examination Report to Application No. 0416625.2 Jan. 20, 2005.
Search and Examination Report to Application No. GB 0416834.0, Nov. 16, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.

Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25608 Feb. 2, 2005.
Written Opinion to Application No. PCT/US02/25675 Nov. 24, 2004.
Written Opinion to Application No. PCT/US02/39425; Nov. 22, 2004.
Written Opinion to Application No. PCT/US03/06544; Feb. 18, 2005.
Written Opinion to Application No. PCT/US03/13787 Nov. 9, 2004.
Written Opinion to Application No. PCT/US03/14153 Nov. 9, 2004.
Written Opinion to Application No. PCT/US03/19993 Oct. 15, 2004.
Written Opinion to Application No. PCT/US03/29858 Jan. 21, 2004.
Written Opinion to Application No. PCT/US03/38550 Dec. 10, 2004.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08171 Feb. 16, 2005.
Combined Search Report and Written Opinion to Application No. PCT/US04/11172 Feb. 14, 2005.
Furlow, "Agbada Well Solid Tubulars Expanded Bottom Up, Screens Expanded Top Down," *Offshore*, 2002.
Gilmer et al., "World's First Completion Set Inside Expandable Screen," *High-Tech Wells*, 2003.
Grant et al., "Deepwater Expandable Openhole Liner Case Histories: Learnings Through Field Applications," *Offshore Technology Conference*, OCT 14218, 2002.
Guichelaar et al., "Effect of Micro-Surface Texturing on Breakaway Torque and Blister Formation on Carbon-Graphite Faces in a Mechanical Seal," *Lubrication Engineering*, Aug. 2002.
Gusevik et al., "Reaching Deep Reservoir Targets Using Solid Expandable Tubulars" *Society of Petroleum Engineers*, SPE 77612, 2002.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
Langley, "Case Study: Value in Drilling Derived From Application-Specific Technology," Oct. 2004.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation- Extending Well Life Through The Use of Solid Expandable Casing Systems,".
Merritt et al., "Well Remediation Using Expandable Cased-Hole Liners", *World Oil.*, Jul. 2002.
Merritt et al., "Well Remediation Using Expandable Cased-Hole Liners- Summary of Case Histories".
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et al., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.JETLUBE.com, "Oilfield Catalog—Jet-Lok Product Applicatin Descriptions," 1998.
www.MITCHMET.com, "3d Surface Texture Parameters," 2004.
"Expand Your Opportunities." *Enventure*. CD-ROM. Jun. 1999.
"Expand Your Opportunities." *Enventure*. CD-ROM. May 2001.
International Preliminary Examination Report, Application PCT/US02/25608, Jun. 1, 2005.
International Preliminary Examination Report, Application PCT/US02/39418, Feb. 18, 2005.
International Preliminary Examination Report, Application PCT/US03/06544, May 10, 2005.

International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/25667, May 25, 2005.
International Preliminary Examination Report, Application PCT/US03/29858, May 23, 2005.
International Preliminary Examination Report, Application PCT/US03/38550, May 23, 2005.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/11177, Jun. 9, 2005.
Written Opinion to Application No. PCT/US02/25608, Feb. 2, 2005.
Written Opinion to Application No. PCT/US02/25727, May 17, 2004.
Written Opinion to Application No. PCT/US02/39425, Apr. 11, 2005.
Written Opinion to Application No. PCT/US03/25675, May 9, 2005.
Written Opinion to Application No. PCT/US04/08171, May 5, 2005.
Combined Search Report and Written Opinion to Application No. PCT/US04/00631, Mar. 28, 2005.
Combined Search Report and Written Opinion to Application No. PCT/US04/02122, Feb. 24, 2005.
Combined Search Report and Written Opinion to Application No. PCT/US04/08073, Mar. 4, 2005.
Combined Search Report and Written Opinion to Application No. PCT/US04/28438, Mar. 14, 2005.
Search Report to Application No. GB 0415835.8, Mar. 10, 2005.
Examination Report to Application No. GB 0225505.7, Feb. 15, 2005.
Examination Report to Application No. GB 0400018.8, May 17, 2005.
Examination Report to Application No. GB 0400019.6, May 19, 2005.
Examination Report to Application No. GB 0403891.5, Feb. 14, 2005.
Examination Report to Application No. GB 0403891.5, Jun. 30, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5, Apr. 14, 2005.
Examination Report to Application No. GB 0406257.6, Jan. 25, 2005.
Examination Report to Application No. GB 0406257.6, Jun. 16, 2005.
Examination Report to Application No. GB 0406258.4, Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Examination Report to Application No. GB 0416625.2, Jan. 20, 2005.
Examination Report to Application No. GB 0428141.6, Feb. 9, 2005.
Examination Report to Application No. GB 0500184.7, Feb. 9, 2005.
Examination Report to Application No. GB 0501667.0, May 27, 2005.
Examination Report to Application No. GB 0507979.3, Jun. 16, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0426155.8, Jan. 12, 2005.
Search and Examination Report to Application No. GB 0426156.6, Jan. 12, 2005.
Search and Examination Report to Application No. GB 0426157.4, Jan. 12, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0506697.2, May 20, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil & Gas Reporter*, Sep. 2004.
Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories- Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eemskanaal—2 Groningen," Enventure Global Technology, Feb. 2002.

Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expandable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.
Demong et al., "Breakthroughs Using Solid Expandable Tubulars to Construct Extended Reach Wells," *Society of Petroleum Engineers*, IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore*, Jun. 2003.
Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52, 3 Juillet 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
Enventure Global Technology, Solid Expandable Tubulars are Enabling Technology, *Drilling Contractor*, Mar.-Apr. 2001.
"Enventure Ready to Rejuvinate the North Sea," *Roustabout*, Sep. 2004.
Escobar et al., "Increasing Solid Expandable Tubular Technology Reliability in a Myriad of Downhole Environments," *Society of Petroleum Engineers*, SPE/IADC 81094, 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Mohawk Energy, :Minimizing Drilling Ecoprints Houston, Dec. 16, 2005.
International Preliminary Report on Patentability, Application PCT/US04/00631, Mar. 2, 2006.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28831, Dec. 19, 2005.
Combined Search Report and Written Opinion to Application No. PCT/US04/28889, Nov. 14, 2005.
Examination Report to Application No. GB 0219757.2, Oct. 31, 2004.
Examination Report to Application No. GB 03701281.2, Jan. 31, 2006.
Examination Report to Application No. GB 03723674.2, Feb. 6, 2006.
Examination Report to Application No. GB 0400019.6, Sep. 2, 2005.
Examination Report to Application No. GB 0400019.6, Nov. 4, 2005.
Examination Report to Application No. GB 0406257.6, Mar. 3, 2005.
Examination Report to Application No. GB 0406257.6, Sep. 2, 2005.
Examination Report to Application No. GB 0406257.6, Nov. 9, 2005.
Examination Report to Application No. GB 0406258.4, Jul. 27, 2005.
Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Sep. 15, 2005.
Examination Report to Application No. GB 0428141.6, Feb. 21, 2006.
Examination Report to Application No. GB 0500184.7, Sep. 12, 2005.
Examination Report to Application No. GB 0500600.2, Sep. 6, 2005.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0503470.7, Sep. 22, 2005.
Examination Report to Application No. GB 0506699.8, Sep. 21, 2005.
Examination Report to Application No. GB 0507979.3, Jan. 17, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.

Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Search and Examination Report to Application No. GB 0412876.5, Sep. 27, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2003257878, Jan. 19, 2006.
Examination Report to Application No. AU 2003257881, Jan. 19, 2006.
Search Report to Application No. EP 03071281.2; Nov. 14, 2005.
Search Report to Application No. EP 03723674.2; Nov. 22, 2005.
Search Report to Application No. EP 03728326.4; Mar. 13, 2006.
Search Report to Application No. EP 03752486.5; Feb. 8, 2006.
Search Report to Application No. EP 03759400.9; Mar. 3, 2006.
Adams, "Drilling Engineering: A Complete Well Planning Approach," 1985.
Flatern, "Oilfield Service Trio Target Jules Verne Territory," at http://www.oilonline.com.
Harris, "Tube Welding." At http://www.tubenet.org.uk.technical.ewi.html.
"Pipeline Rehabilitation by Sliplining with Polyethylene Pipe" 2006.
Tumey, "Letter: IP Analysis" May 6, 2006.
www.RIGZONE.com/news/article.asp?a_id=1755, "Tesco Provides Casing Drilling Operations Update," 2001.
www.RIGZONE.com/news/article.asp?a_id=2603, Conoco and Tesco Unveil Revolutionary Drilling Rig 2002.
International Preliminary Examination Report, Application PCT/US01/28690, Sep. 4, 2003.
International Preliminary Report on Patentability, Application PCT/US04/04740, Jun. 27, 2006.
International Preliminary Report on Patentability, Application PCT/US04/10317, Jun. 23, 2006.
International Preliminary Report on Patentability, Application PCT/US04/028423, Mar. 9, 2006.
International Preliminary Report on Patentability, Application PCT/US04/028423, Jun. 19, 2006.
International Preliminary Report on Patentability, Application PCT/US04/28889, Aug. 1, 2006.
Combined Search Report and Written Opinion to Application No. PCT/US04/07711, Nov. 28, 2006.
Combined Search Report and Written Opinion to Application No. PCT/US04/10317, May 25, 2006.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819, Aug. 3, 2006.
Combined Search Report and Written Opinion to Application No. PCT/US05/28869, Apr. 17, 2006.
Combined Search Report and Written Opinion to Application No. PCT/US06/04809, Aug. 29, 2006.
Combined Search Report and Written Opinion to Application No. PCT/US06/09886, Dec. 4, 2006.
Search Report to Application No. GB 0507980.1, Apr. 24, 2006.
Examination Report to Application No. GB 0406257.6, Apr. 28, 2006.
Examination Report to Application No. GB 0428141.6, Jul. 18, 2006.
Examination Report to Application No. GB 0500275.3, Apr. 5, 2006.
Examination Report to Application No. GB 0503250.3, Aug. 11, 2006.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0506702.0, Jul. 24, 2006.
Examination Report to Application No. GB 0507979.3, Jun. 6, 2006.
Examination Report to Application No. GB 0509630.0, Jun. 6, 2006.
Examination Report to Application No. GB 0517448.7, Jul. 19, 2006.
Examination Report to Application No. GB 0518025.2, Jun. 23, 2006.
Examination Report to Application No. GB 0518039.3, Aug. 2, 2006.
Examination Report to Application No. GB 0518252.2, May 25, 2006.

Examination Report to Application No. GB 0518799.2, Jun. 14, 2006.
Examination Report to Application No. GB 0518893.3, Jul. 28, 2006.
Examination Report to Application No. GB 0521931.6, Nov. 8, 2006.
Examination Report to Application No. GB 0522892.9, Aug. 14, 2006.
Examination Report to Application No. GB 0603576.0, Apr. 5, 2006.
Examination Report to Application No. GB 0603576.0, Nov. 9, 2006.
Examination Report to Application No. GB 0603656.0, May 3, 2006.
Examination Report to Application No. GB 0603656.0, Nov. 10, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0507980.1, Jun. 20, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 03723674.2; May 2, 2006.
Search Report to Application No. EP 03728326.4; Apr. 24, 2006.
Examination Report to Application No. EP 03752486.5; Jun. 28, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Examination Report to Application No. Norway 2002 1613, May 13, 2006.
Examination Report to Application No. Norway 20023885, May 29, 2006.
Examination Report To Application No. Canada 2298139, Nov. 15, 2006.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Jul. 4, 2007 on European Patent Application No. 3728326.4.
Examination Report dated Apr. 2, 2007 on European Patent Application No. 3701281.2.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Aug. 7, 2007 on British patent application No. 624327.3.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 207 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British Patent application No. 702797.2.

Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.

* cited by examiner

COLLAPSIBLE EXPANSION CONE

CROSS REFERENCE TO RELATED APPLICATIONS

The present application is the National Stage patent application corresponding to PCT patent application Ser. No. PCT/US02/36157, filed on Nov. 12, 2002, which claimed the benefit of the filing dates of: (1) U.S. provisional patent application Ser. No. 60/338,996, filed on Nov. 12, 2001, (2) U.S. provisional patent application Ser. No. 60/339,013, filed on Nov. 12, 2001 (3) U.S. provisional patent application Ser. No. 60/363,829, filed on Mar. 13, 2002, and (4) U.S. provisional patent application Ser. No. 60/387,961, filed on Jun. 12, 2002, the disclosures of which are incorporated herein by reference.

The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. Pat. No. 6,328,113, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,021, filed on Sep. 7, 2001, (29) U.S. provisional patent application Ser. No. 60/3318,386, filed on Sep. 10, 2001, (30) U.S. provisional patent application Ser. No. 60/326,886, filed on Oct. 3, 2001, (31) U.S. utility patent application Ser. No. 09/969,922, filed on Oct. 3, 2001, (32) U.S. provisional patent application Ser. No. 60/338,996, filed on Nov. 12, 2001, (33) U.S. provisional patent application Ser. No. 60/339,013, filed on Nov. 12, 2001, (34) U.S. utility patent application Ser. No. 10/016,467, filed on Dec. 10, 2001, (35) U.S. provisional patent application Ser. No. 60/343,674, filed on Dec. 27, 2001, (36) U.S. provisional patent application Ser. No. 60/346,309, filed on Jan. 7, 2002, (37) U.S. provisional patent application Ser. No. 60/357,372, filed on Feb. 15, 2002, (38) U.S. provisional patent application Ser. No. 60/363,829, filed on Mar. 13, 2002, (39) U.S. provisional patent application Ser. No. 60/372,048, filed on Apr. 12, 2002, (40) U.S. provisional patent application Ser. No. 60/372,632, filed on Apr. 15, 2002, (41) U.S. provisional patent application Ser. No. 60/380,147, filed on May 6, 2002, (42) U.S. provisional patent application Ser. No. 60/383,917, filed on May 29, 2002, (43) U.S. provisional patent application Ser. No. 60/387,486, filed on Jun. 10, 2002, (44) U.S. provisional patent application Ser. No. 60/387,961, filed on Jun. 12, 2002, (45) U.S. provisional patent application Ser. No. 60/391,703, filed on Jun. 26, 2002, (46) U.S. provisional patent application Ser. No. 60/397,284, filed on Jul. 19, 2002, (47) U.S. provisional patent application Ser. No. 60/398,061, filed on Jul. 24, 2002, (48) U.S. provisional patent application Ser. No. 60/399,240, filed on Jul. 29, 2002, (49) U.S. provisional patent application Ser. No. 60/405,610, filed on Aug. 23, 2002, (50) U.S. provisional patent application Ser. No. 60/405,394, filed on Aug. 23, 2002, (51) U.S. provisional patent application Ser. No. 60/407,442, filed on Aug. 30, 2002, (52) U.S. provisional patent application Ser. No. 60/412,542, filed on Sep. 20, 2002, (53) U.S. provisional patent application Ser. No. 60/412,177, filed on Sep. 20, 2002, (54) U.S. provisional patent application Ser. No. 60/412,653, filed on Sep. 20, 2002, (55) U.S. provisional patent application Ser. No. 60/412,544, filed on Sep. 20, 2002, (56) U.S. provisional patent application Ser. No. 60/412,187, filed on Sep. 20, 2002, (57) U.S. provisional patent application Ser. No. 60/412,187, filed on Sep. 20, 2002, (58) U.S. provisional patent application Ser. No. 60/412,487, filed on Sep. 20, 2002, (59) U.S. provisional patent application Ser. No. 60/412,488, filed on Sep. 20, 2002, and (60) U.S. provisional patent application Ser. No. 60/412,371, filed on Sep. 20, 2002, (61) PCT Patent Application No. PCT/US02/36157, filed on Nov. 11, 2002 and (62) PCT Patent Application No. PCT/US02/36267, filed on Nov. 11, 2002, the disclosures of which are incorporated herein by reference.

BACKGROUND OF THE INVENTION

This invention relates generally to oil and gas exploration, and in particular to forming and repairing wellbore casings to facilitate oil and gas exploration.

During oil exploration, a wellbore typically traverses a number of zones within a subterranean formation. Wellbore casings are then formed in the wellbore by radially expanding and plastically deforming tubular members that are coupled to one another by threaded connections. Existing methods for radially expanding and plastically deforming tubular members coupled to one another by threaded connections are not always reliable or produce satisfactory results. In particular, the threaded connections can be damaged during the radial expansion process.

The present invention is directed to overcoming one or more of the limitations of the existing processes for radially expanding and plastically deforming tubular members coupled to one another by threaded connections.

SUMMARY OF THE INVENTION

According to one aspect of the present invention, an apparatus for radially expanding and plastically deforming an expandable tubular member is provided that includes an upper tubular support member defining a first passage, one or more cup seals coupled to the exterior surface of the upper tubular support member for sealing an interface between the upper tubular support member and the expandable tubular member, an upper cam assembly coupled to the upper tubular support member comprising: a tubular base coupled to the upper tubular support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the tubular support member, a lower tubular support member defining a second passage fluidicly coupled to the first passage releasably coupled to the upper tubular support member, and a lower cam assembly coupled to the lower tubular support member comprising: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly, wherein the lower expansion cone segments interleave and overlap the upper expansion cone segments, and wherein the upper and lower expansion cone segments together define an arcuate spherical external surface for plastically deforming and radially expanding the expandable tubular member.

According to another aspect of the present invention, a collapsible expansion cone assembly is provided that includes an upper tubular support member comprising an internal flange, an upper cam assembly coupled to the upper tubular support member comprising: a tubular base coupled to the upper support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the internal flange of the upper tubular support member, a lower tubular support member comprising an internal flange, one or more frangible couplings for releasably coupling the upper and lower tubular support members, a lower cam assembly coupled to the lower tubular support member comprising: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly, wherein the lower expansion cone segments interleave and overlap the upper expansion cone segments, and wherein the upper and lower expansion cone segments together define an arcuate spherical external surface for plastically deforming and radially expanding the expandable tubular member.

According to another aspect of the present invention, an apparatus for radially expanding and plastically deforming an expandable tubular member is provided that includes a tubular support member, a collapsible expansion cone coupled to the tubular support member, an expandable tubular member coupled to the collapsible expansion cone, means for displacing the collapsible expansion cone relative to the expandable tubular member, and means for collapsing the expansion cone.

According to another aspect of the present invention, a collapsible expansion cone is provided that includes an upper cam assembly comprising: a tubular base, and a plurality of cam arms extending from the tubular base in a downward longitudinal direction, each cam arm defining an inclined surface, a plurality of upper expansion cone segments interleaved with the cam arms of the upper cam assembly, a lower cam assembly comprising: a tubular base, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, a plurality of lower expansion cone segments interleaved with cam arms of the lower cam assembly, each lower expansion cone segment mating with the inclined surface of a corresponding one of the cam arms of the upper cam assembly, means for moving the upper cam assembly away from the lower expansion cone segments, and means for moving the lower cam assembly away from the upper expansion cone segments.

According to another aspect of the invention, an apparatus for radially expanding and plastically deforming an expandable tubular member is provided that includes a tubular support member, a collapsible expansion cone coupled to the tubular support member, an expandable tubular member coupled to the collapsible expansion cone, means for displacing the collapsible expansion cone relative to the expandable tubular member, and means for collapsing the expansion cone.

According to another aspect of the invention, a collapsible expansion cone is provided that includes an upper cam assembly comprising: a tubular base, and a plurality of cam arms extending from the tubular base in a downward longitudinal direction, each cam arm defining an inclined surface, a plurality of upper expansion cone segments interleaved with the cam arms of the upper cam assembly, a lower cam assembly comprising: a tubular base, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, a plurality of lower expansion cone segments interleaved with cam arms of the lower cam assembly, each lower expansion cone segment mating with the inclined surface of a corresponding one of the cam arms of the upper cam assembly, means for moving the upper cam assembly away from the lower expansion cone segments, and means for moving the lower cam assembly away from the upper expansion cone segments.

According to another aspect of the invention, a method of radially expanding and plastically deforming an expandable tubular member is provided that includes supporting the expandable tubular member using a tubular support member and a collapsible expansion cone, injecting a fluidic material into the tubular support member, sensing the operating pressure of the injected fluidic material within a first interior portion of the tubular support member, displacing the collapsible expansion cone relative to the expandable tubular member when the sensed operating pressure of the injected fluidic material exceeds a predetermined level within the first interior portion of the tubular support member, sensing the operating pressure of the injected fluidic material within a second interior portion of the tubular support member, and collapsing the collapsible expansion cone when the sensed operating pressure of the injected fluidic material exceeds a predetermined level within the second interior portion of the tubular support member.

DETAILED DESCRIPTION OF THE ILLUSTRATIVE EMBODIMENTS

Figure 1A:
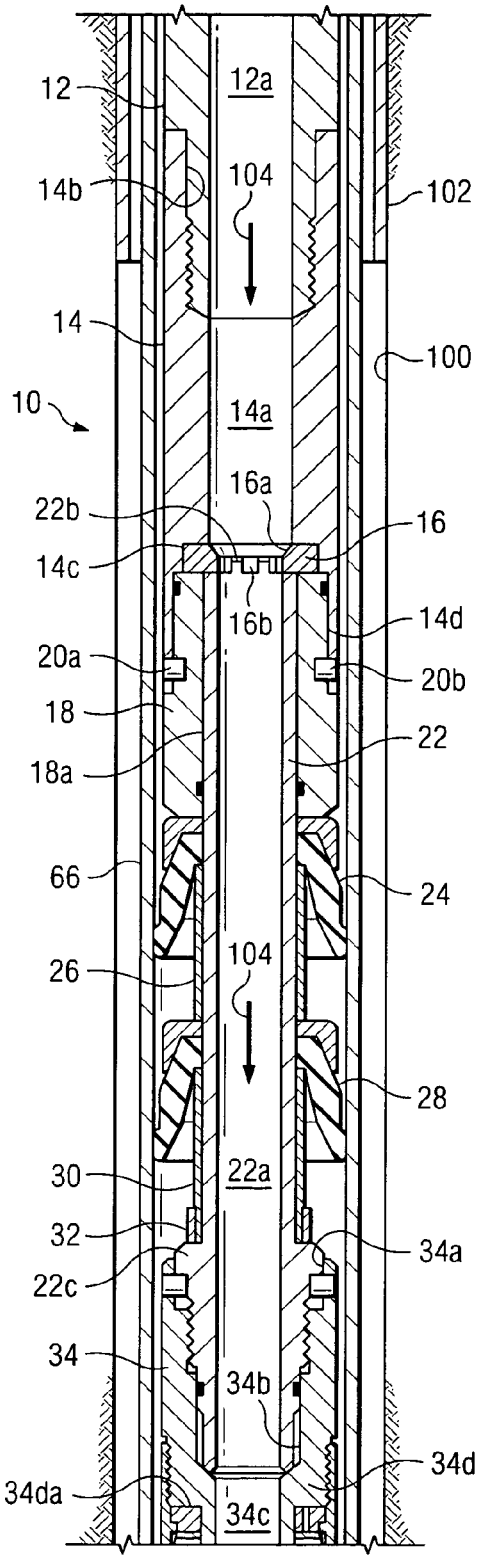
FIG. 1*a* is a fragmentary cross-sectional illustration of the placement of a portion of an exemplary embodiment of an apparatus for radially expanding and plastically deforming a tubular member that includes a collapsible expansion cone within a preexisting structure.

Referring to FIGS. 1*a*, 1*b*, 2*a*, 2*b*, 3, 3*a*, 4, 4*a*, 5, 6, 7*a*, 7*b*, 7*c*, 7*d*, 7*e*, 7*f*, 8*a*, 8*b*, 8*c*, 8*d*, 8*e*, and 9, an exemplary embodiment of an apparatus 10 for radially expanding and plastically deforming a tubular member includes a tubular support member 12 that defines a passage 12*a*. An end of the tubular support member 12 is coupled to an end of a safety collar 14 that defines a passage 14*a*, a recess 14*b* at one end for receiving the end of the tubular support member, and recesses 14*c* and 14*d* at another end.

A torque plate 16 is received within and is coupled to the recess 14*c* of the safety collar 14 that defines a passage 16*a* and a plurality of meshing teeth 16*b* at one end. An end of an upper mandrel collar 18 is received with and is coupled to the recess 14*d* of the safety collar 14 proximate and end of the torque plate 16 that defines a passage 18*a*. Torque pins 20*a* and 20*b* further couple the end of the upper mandrel collar 18 to the end of the safety collar 14.

An end of an upper mandrel 22 is received within and is coupled to the upper mandrel collar 18 that defines a passage 22*a*, a plurality of meshing teeth 22*b* that mate with and transmit torque to and from the meshing teeth 16*b* of the torque plate 16, and an external flange 22*c* at another end.

An upper packer cup 24 mates with, receives and is coupled to the upper mandrel 22 proximate the end of the upper mandrel collar 18. In an exemplary embodiment, the upper packer cup 24 is a Guiberson™ packer cup. An upper spacer sleeve 26 mates with, receives, and is coupled to the upper mandrel 22 proximate an end of the upper packer cup 24. A lower packer cup 28 mates with, receives and is coupled to the upper mandrel 22 proximate an end of the upper spacer sleeve 26. In an exemplary embodiment, the lower packer cup 28 is a Guiberson™ packer cup. A lower spacer sleeve 30 mates with, receives, and is coupled to the upper mandrel 22 proximate an end of the lower packer cup 28 and the external flange 22*c* of the upper mandrel. A retaining sleeve 32 mates with, receives, and is coupled to an end of the lower spacer sleeve proximate the external flange 22*c* of the upper mandrel 22.

An end of a lower mandrel 34 defines a recess 34*a* that mates with, receives, and is coupled to the external flange 22*c* of the upper mandrel 22, a recess 34*b* that mates with, receives, and is coupled to the end of the upper mandrel, a passage 34*c*, and an external flange 34*d* including circumferentially spaced apart meshing teeth 34*da* on an end face of the external flange. Torque pins 36*a* and 36*b* further couple the recess 34*a* of the end of the lower mandrel 34 to the external flange 22*c* of the upper mandrel 22. During operation, the torque pins 36*a* and 36*b* transmit torque loads between the recess 34*a* of the end of the lower mandrel 34 and the external flange 22*c* of the upper mandrel 22.

An upper cam assembly 38 includes a tubular base 38*a* for receiving and mating with the lower mandrel 34 that includes an external flange 38*aa*, a plurality of circumferentially spaced apart meshing teeth 38*b* that extend from one end of the tubular base in the longitudinal and radial directions for engaging the meshing teeth 34*da* of the end face of the external flange 34*d* of the lower mandrel, and a plurality of circumferentially spaced apart cam arms 38*c* that extend from the other end of the tubular base in the opposite longitudinal direction and mate with and receive the lower mandrel. During operation, the meshing teeth 34*da* of the end face of the external flange 34*d* of the lower mandrel 34 transmit torque loads to the meshing teeth 38*b* of the upper cam assembly 38. Each of the cam arms 38*c* include an inner portion 38*ca* extending from the tubular base 38*a* that has arcuate cylindrical inner and outer surfaces, 38*caa* and 38*cab*, a tapered intermediate portion 38*cb* extending from the inner portion that has an arcuate cylindrical inner surface 38*cba* and an arcuate conical outer surface 38*cbb*, and an outer portion 38*cc* extending from the intermediate portion that has arcuate cylindrical inner and outer surfaces, 38*cca* and 38*ccb*. In an exemplary embodiment, the radius of curvatures of the arcuate outer cylindrical surfaces 38*cab* are greater than the radius of curvatures of the arcuate outer cylindrical surfaces 38*ccb*. In an exemplary embodiment, the radius of curvatures of the arcuate inner cylindrical surfaces, 38*caa*, 38*cba*, and 38*cca* are equal.

A lower cam assembly 40 includes a tubular base 40*a* for receiving and mating with the lower mandrel 34 that includes an external flange 40*aa*, a plurality of circumferentially spaced apart meshing teeth 40*b* that extend from one end of the tubular base in the longitudinal and radial directions, and a plurality of circumferentially spaced apart cam arms 40*c* that extend from the other end of the tubular base in the opposite longitudinal direction and mate with and receive the lower mandrel. Each of the cam arms 40*c* include an inner portion 40*ca* extending from the tubular base 40*a* that has arcuate cylindrical inner and outer surfaces, 40*caa* and 40*cab*, a tapered intermediate portion 40*cb* extending from the inner portion 40*ca* that has an arcuate cylindrical inner surface 40*cba* and an arcuate conical outer surface 40*cbb*, and an outer portion 40*cc* extending from the intermediate portion that has arcuate cylindrical inner and outer surfaces, 40*cca* and 40*ccb*. In an exemplary embodiment, the radius of curvatures of the arcuate outer cylindrical surfaces 40*cab* are greater than the radius of curvatures the arcuate outer cylindrical surfaces 40*ccb*. In an exemplary embodiment, the radius of curvatures of the arcuate inner cylindrical surfaces, 40*caa*, 40*cba*, and 40*cca* are equal. In an exemplary embodiment, the upper and lower cam assemblies, 38 and 40, are substantially identical. In an exemplary embodiment, the cam arms 38*c* of the upper cam assembly 38 interleave the cam arms 40*c* of the lower cam assembly 40. Furthermore, in an exemplary embodiment, the cam arms 38*c* of the upper cam assembly also overlap with the cam arms 40*c* of the lower cam assembly 40 in the longitudinal direction thereby permitting torque loads to be transmitted between the upper and lower cam assemblies.

An end of an upper retaining sleeve 42 receives and is threadably coupled to the external flange 34*d* of the lower mandrel 34 that defines a passage 42*a* for receiving and mating with the outer circumferential surfaces of the external flange 38*aa* and the meshing teeth 38*b* of the upper cam assembly 38, and an inner annular recess 42*b*, and includes an internal flange 42*c* for retaining the external flange 38*aa* of the upper cam assembly, and an internal flange 42*d* at one end of the upper retaining sleeve that includes a rounded interior end face. An o-ring seal 44 is received within the annular recess 42*b* for sealing the interface between the upper retaining sleeve 42 and the external flange 34*d* of the lower mandrel 34. A disc shaped shim 43 is positioned within the upper retaining sleeve 42 between the opposing end faces of the internal flange 42*c* of the retaining sleeve and the meshing teeth 38*b* of the upper cam assembly 38.

A plurality of upper expansion cone segments 44 are interleaved among the cam arms 38*c* of the upper cam assembly 38. Each of the upper expansion cone segments 44 include inner portions 44*a* having arcuate cylindrical inner surfaces, 44*aaa* and 44*aab*, and an arcuate cylindrical outer surface 44*ab*, intermediate portions 44*b* extending from the interior portions that have an arcuate conical inner surface 44*ba* and arcuate cylindrical and spherical outer surfaces, 44*bba* and 44*bbb*, and outer portions 44*c* having arcuate cylindrical inner and outer surfaces, 44*ca* and 44*cb*. In an exemplary embodiment, the outer surfaces 44*ab* of the inner portions 44*a* of the upper expansion cone segments define hinge grooves 44*aba* that receive and are pivotally mounted upon the internal flange 42*d* of the upper retaining sleeve 42.

The arcuate inner cylindrical surfaces 44*aaa* mate with and receive the lower mandrel 34, the arcuate inner cylindrical surfaces 44*aab* mate with and receive the arcuate cylindrical outer surfaces 40*ccb* of the outer portions 40*cc* of the corresponding cam arms 40*c* of the lower cam assembly 40, and the arcuate inner conical surfaces 44*ba* mate with and receive the arcuate conical outer surfaces 40*cbb* of the intermediate portions 40*cb* of the corresponding cam arms of the lower cam assembly.

In an exemplary embodiment, the radius of curvature of the arcuate cylindrical inner surface 44*aaa* is less than the radius of curvature of the arcuate cylindrical inner surface 44*aab*. In an exemplary embodiment, the radius of curvature of the arcuate cylindrical inner surface 44*ca* is greater than the radius of curvature of the arcuate cylindrical surface 44*aab*. In an exemplary embodiment, the arcuate cylindrical inner surfaces, 44*aaa* and 44*aab*, are parallel. In an exemplary embodiment, the arcuate cylindrical outer surface 44*ab* is inclined relative to the arcuate cylindrical inner surface 44*aaa*. In an exemplary embodiment, the arcuate cylindrical outer surface 44*bba* is parallel to the arcuate cylindrical inner surfaces, 44*aaa* and 44*aab*. In an exemplary embodiment, the arcuate cylindrical outer surface 44*cb* is inclined relative to the arcuate cylindrical inner surface 44*ca*.

A plurality of lower expansion cone segments 46 are interleaved among, and overlap, the upper expansion cone segments 44 and the cam arms 38*c* of the lower cam assembly 38. In this manner, torque loads may be transmitted between the upper and lower expansion cone segments, 44 and 46. Each of the lower expansion cone segments 46 include inner portions 46*a* having arcuate cylindrical inner surfaces, 46*aaa* and 46*aab*, and an arcuate cylindrical outer surface 46*ab*, intermediate portions 46*b* extending from the interior portions that have an arcuate conical inner surface 46*ba* and arcuate cylindrical and spherical outer surfaces, 46*bba* and 46*bbb*, and outer portions 46*c* having arcuate cylindrical inner and outer surfaces, 46*ca* and 46*cb*. In an exemplary embodiment, the outer surfaces 46*ab* of the inner portions 46*a* of the upper expansion cone segments 46 define hinge grooves 46*aba*.

The arcuate inner cylindrical surfaces 46*aaa* mate with and receive the lower mandrel 34, the arcuate inner cylindrical surfaces 46*aab* mate with and receive the arcuate cylindrical outer surfaces 38*ccb* of the outer portions 38*cc* of the corresponding cam arms 38*c* of the upper cam assembly 38, and the arcuate inner conical surfaces 46*ba* mate with and receive the arcuate conical outer surfaces 38*cbb* of the intermediate portions 38*cb* of the corresponding cam arms of the lower cam assembly.

In an exemplary embodiment, the radius of curvature of the arcuate cylindrical inner surface 46*aaa* is less than the radius of curvature of the arcuate cylindrical inner surface 46*aab*. In an exemplary embodiment, the radius of curvature of the arcuate cylindrical inner surface 46*ca* is greater than the radius of curvature of the arcuate cylindrical surface 46*aab*. In an exemplary embodiment, the arcuate cylindrical inner surfaces, 46*aaa* and 46*aab*, are parallel. In an exemplary embodiment, the arcuate cylindrical outer surface 46*ab* is inclined relative to the arcuate cylindrical inner surface 46*aaa*. In an exemplary embodiment, the arcuate cylindrical outer surface 46*bba* is parallel to the arcuate cylindrical inner surfaces, 46*aaa* and 46*aab*. In an exemplary embodiment, the arcuate cylindrical outer surface 46*cb* is inclined relative to the arcuate cylindrical inner surface 46*ca*.

In an exemplary embodiment, the geometries of the upper and lower expansion cone segments 44 and 46 are substantially identical. In an exemplary embodiment, the upper expansion cone segments 44 are tapered in the longitudinal direction from the ends of the intermediate portions 44*b* to the ends of the outer portions 44*c*, and the lower expansion cone segments 46 are tapered in the longitudinal direction from the ends of the intermediate portions 46*b* to the ends of the outer portions 46*c*. In an exemplary embodiment, when the upper and lower expansion segments, 44 and 46, are positioned in a fully expanded position, the arcuate cylindrical outer surfaces, 44*bba* and 46*cb*, of the upper and lower expansion cone segments define a contiguous cylindrical surface, the arcuate spherical outer surfaces, 44*bbb* and 46*bbb*, of the upper and lower expansion cone segments define an contiguous arcuate spherical surface, and the arcuate cylindrical outer surfaces, 44*cb* and 46*bba*, of the upper and lower expansion cone segments define a contiguous cylindrical surface.

An end of a lower retaining sleeve 48 defines a passage 48*a* for receiving and mating with the outer circumferential surfaces of the external flange 40*aa* and the meshing teeth 40*b* of the lower cam assembly 40, and an inner annular recess 48*b*, and includes an internal flange 48*c* for retaining the external flange of the lower cam assembly, and an internal flange 48*d* at one end of the lower retaining sleeve that includes a rounded interior end face for mating with the hinge grooves 46*aba* of the lower expansion cone segments 46 thereby pivotally coupling the lower expansion cone segments to the lower retaining sleeve. An o-ring seal 50 is received within the annular recess 48*b*. A disc shaped shim 49 is positioned within the lower retaining sleeve 48 between the opposing end faces of the internal flange 48*c* of the retaining sleeve and the external flange 40*aa* of the lower cam assembly 40.

In an exemplary embodiment, the arcuate cylindrical outer surfaces 44*bba* of the upper expansion cone segments 44 and the arcuate cylindrical outer surfaces 46*cb* of the lower expansion cone segments 46 are aligned with the outer surface of the upper retaining sleeve 42. In an exemplary embodiment, the arcuate cylindrical outer surfaces 44*cb* of the upper expansion cone segments 44 and the arcuate cylindrical outer surfaces 46*bba* of the lower expansion cone segments are aligned with the outer surface of the lower retaining sleeve 48.

An end of a float shoe adaptor 50 that includes a plurality of circumferentially spaced apart meshing teeth 50*a* for engaging the meshing teeth 40*b* of the lower cam assembly 40 is received within and threadably coupled to an end of the lower retaining sleeve 48 that defines a passage 50*b* at one end for receiving an end of the lower mandrel 34, a passage 50*c* having a reduced inside diameter at another end, a plurality of radial passages 50*d* at the other end, and includes an internal flange 50*e*, and a torsional coupling 50*f* at the other end that includes a plurality of torsional coupling members 50*fa*. During operation, the meshing teeth 40*b* of the lower cam assembly 40 transmit toque loads to and from the meshing teeth 50*a* of the float shoe adaptor.

An end of a retaining sleeve 52 abuts the end face of the tubular base 40*a* of the lower cam assembly 40 and is received within and mates with the passage 50*b* of the float shoe adaptor 50 that defines a passage 52*a* for receiving an end of the lower mandrel 34, a throat passage 52*b* including a ball valve seat 52*c*, and includes a flange 52*d*, and another end of the retaining sleeve, having a reduced outside diameter, is received within and mates with the passage 50*c* of the float shoe adaptor 50.

A stop nut 54 receives and is threadably coupled to the end of the lower mandrel 34 within the passage 52*a* of the retaining sleeve 52, and shear pins 56 releasably couple the stop nut 54 to the retaining sleeve 52. Locking dogs 58 are positioned within an end of the retaining sleeve 52 that receive and are releasably coupled to the lower mandrel 34, and a disc shaped adjustment shim 60 receives the lower mandrel 34 and is positioned within an end of the retaining sleeve 52 between the opposing ends of the tubular base 40*a* of the upper cam assembly 40 and the locking dogs 58. Burst discs 62 are releasably coupled to and positioned within the radial passages 50*d* of the float shoe adaptor 50.

An end of a float shoe 64 mates with and is releasably coupled to the torsional coupling members 50*fa* of the torsional coupling 50*f* of the float shoe adaptor 50 that defines a passage 64*a* and a valveable passage 64*b*. In this manner torsional loads may be transmitted between the float shoe adaptor 50 and the float shoe 64. An end of an expandable tubular member 66 that surrounds the tubular support member 12, the safety collar 14, the upper mandrel collar 18, the upper packer cup 24, the lower packer cup 28, the lower mandrel 34, the upper expansion cone segments 44, the lower expansion cone segments 46, and the float shoe adaptor 50, is coupled to and receives an end of the float shoe 64 and is movably coupled to and supported by the arcuate spherical external surfaces, 44*bbb* and 46*bbb*, of the upper and lower expansion cone segments, 44 and 46.

Figure 1B:
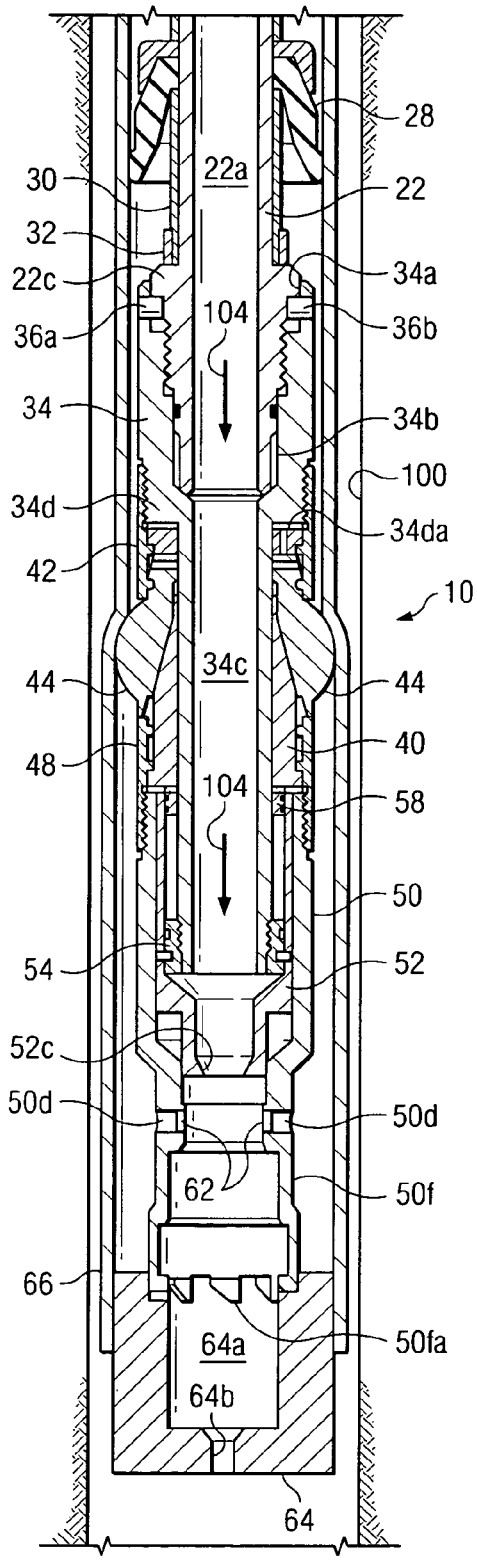
FIG. 1*b* is a fragmentary cross-sectional illustration of another portion of the apparatus of FIG. 1*a*.
Figure 2A:
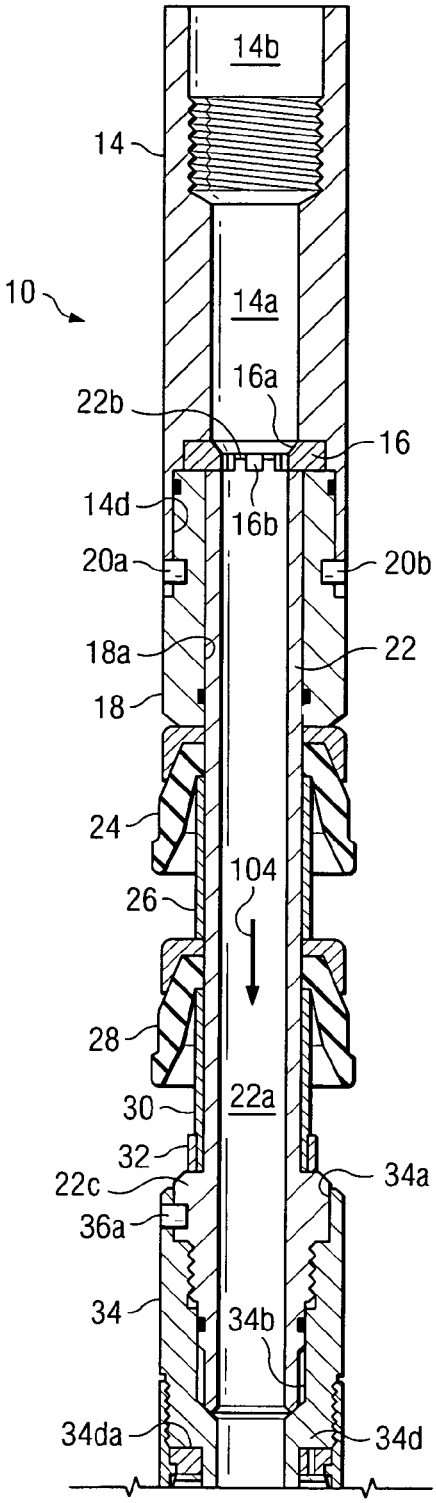
FIGS. 2*a* and 2*b* are fragmentary cross-sectional illustration of a portion of the apparatus of FIGS. 1*a* and 1*b*.
Figure 2B:
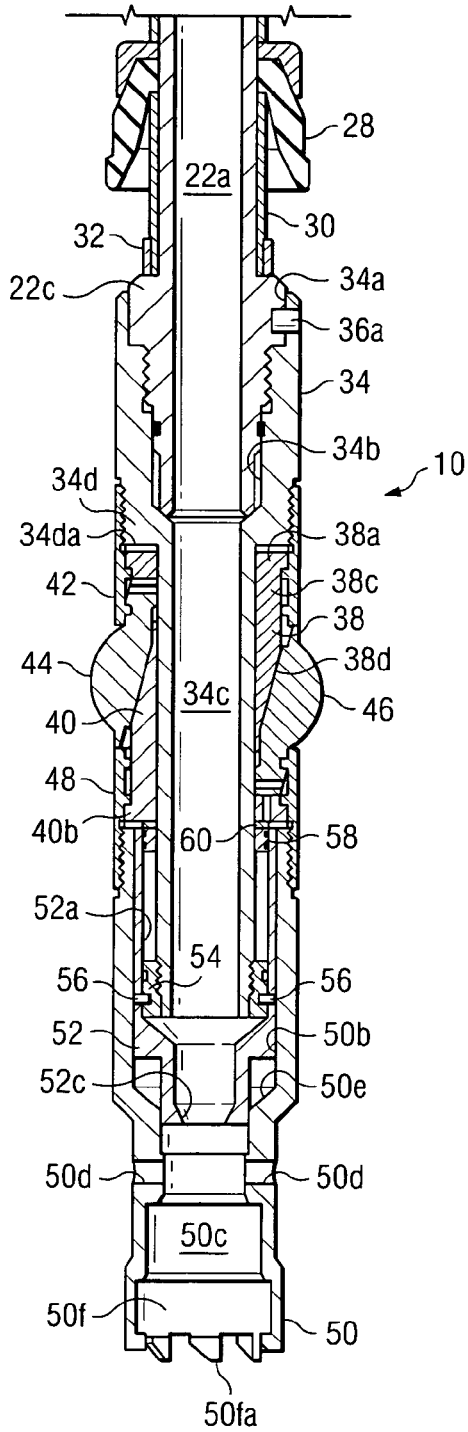
Figure 3:
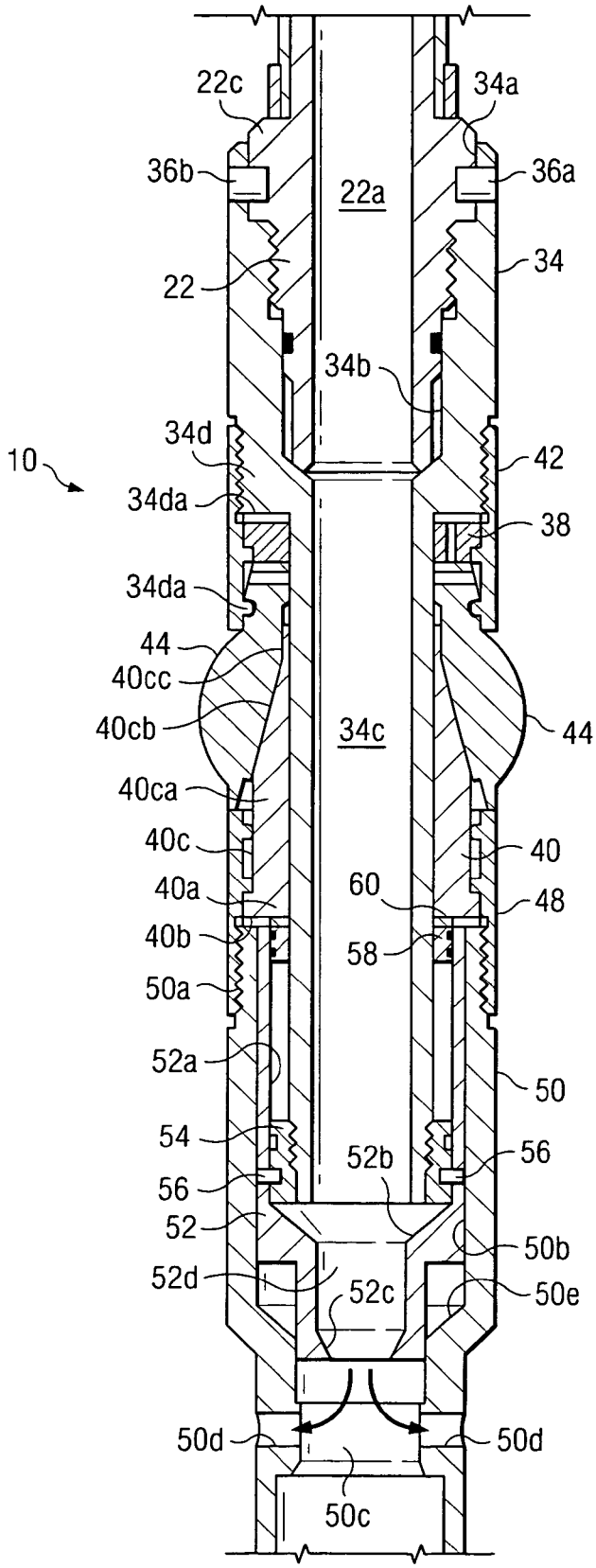
FIG. 3 is a fragmentary cross-sectional illustration of a portion of the apparatus of FIGS. 1*a* and 1*b*.
Figure 3A:
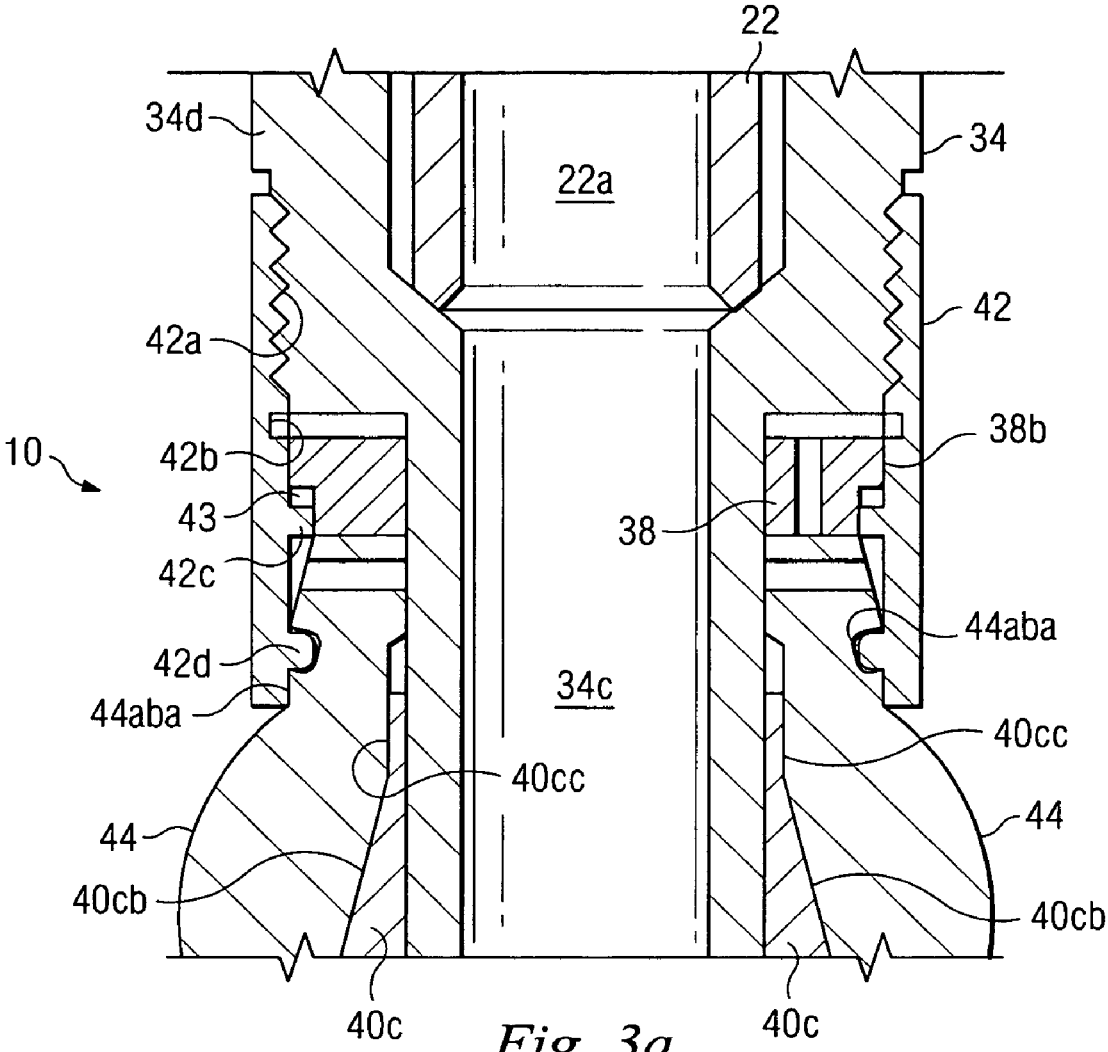
FIG. 3*a* is a fragmentary cross-sectional illustration of a portion of the apparatus of FIG. 3.
Figure 3B:
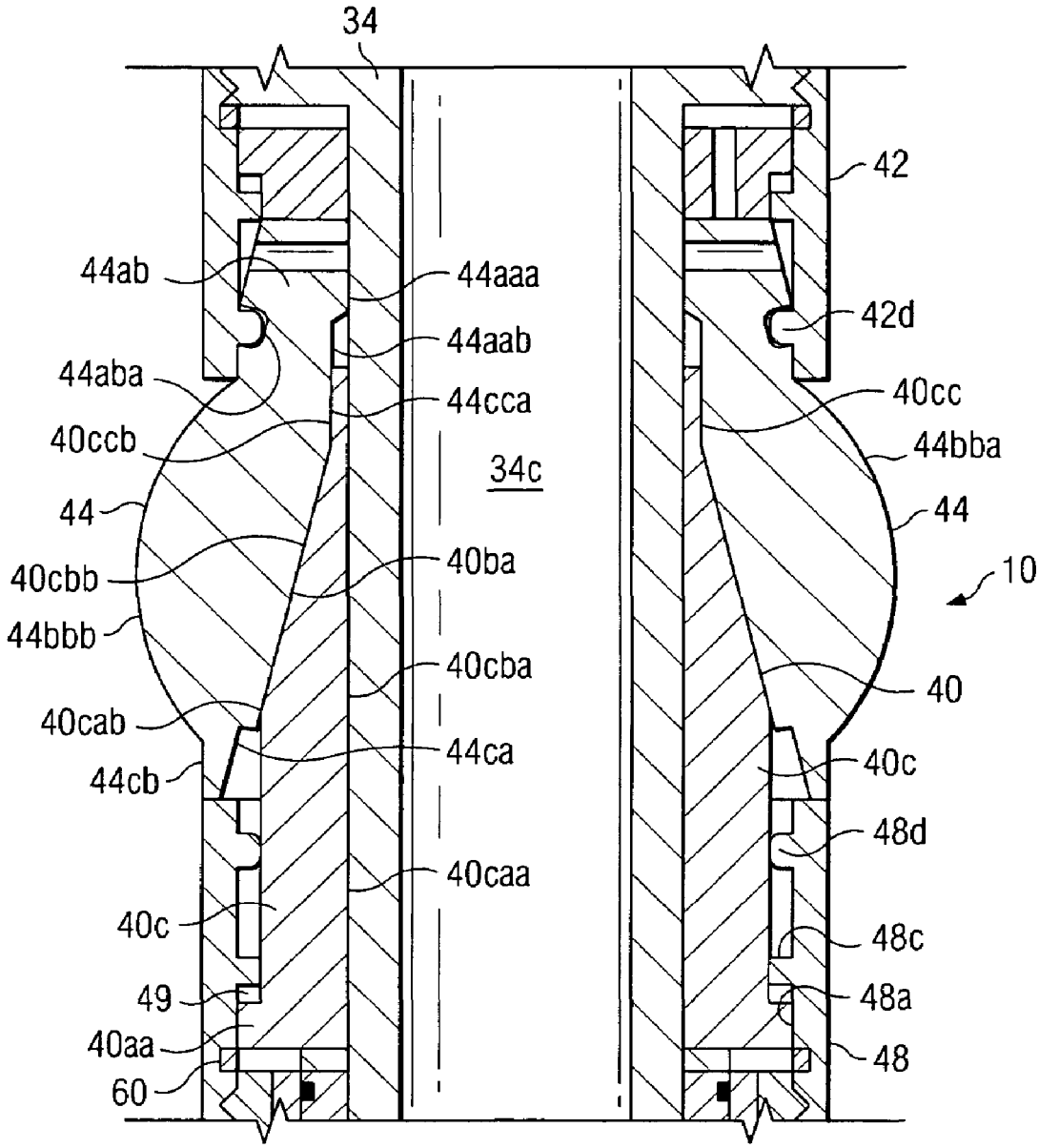
FIG. 3*b* is a fragmentary cross-sectional illustration of a portion of the apparatus of FIG. 3.
Figure 4:
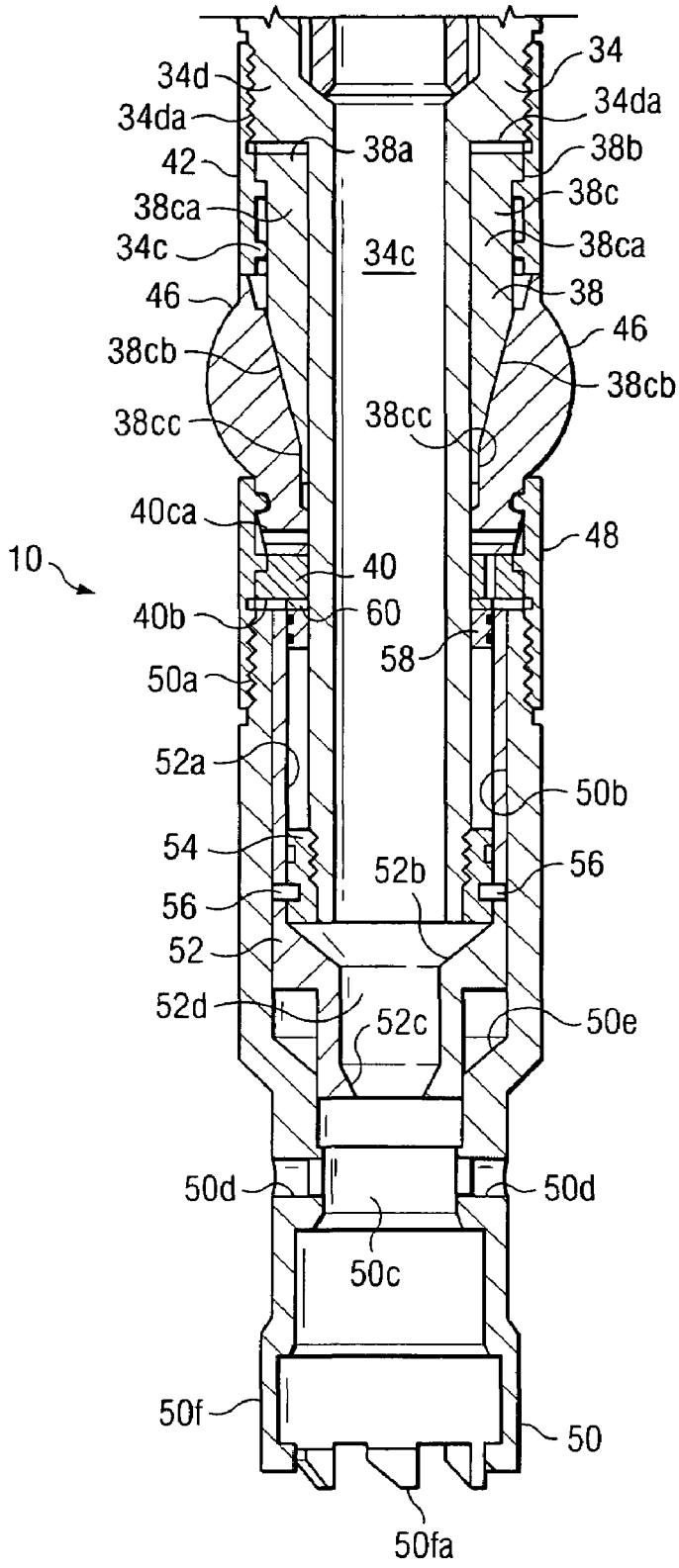
FIG. 4 is a fragmentary cross-sectional illustration of a portion of the apparatus of FIGS. 1*a* and 1*b*.
Figure 4A:
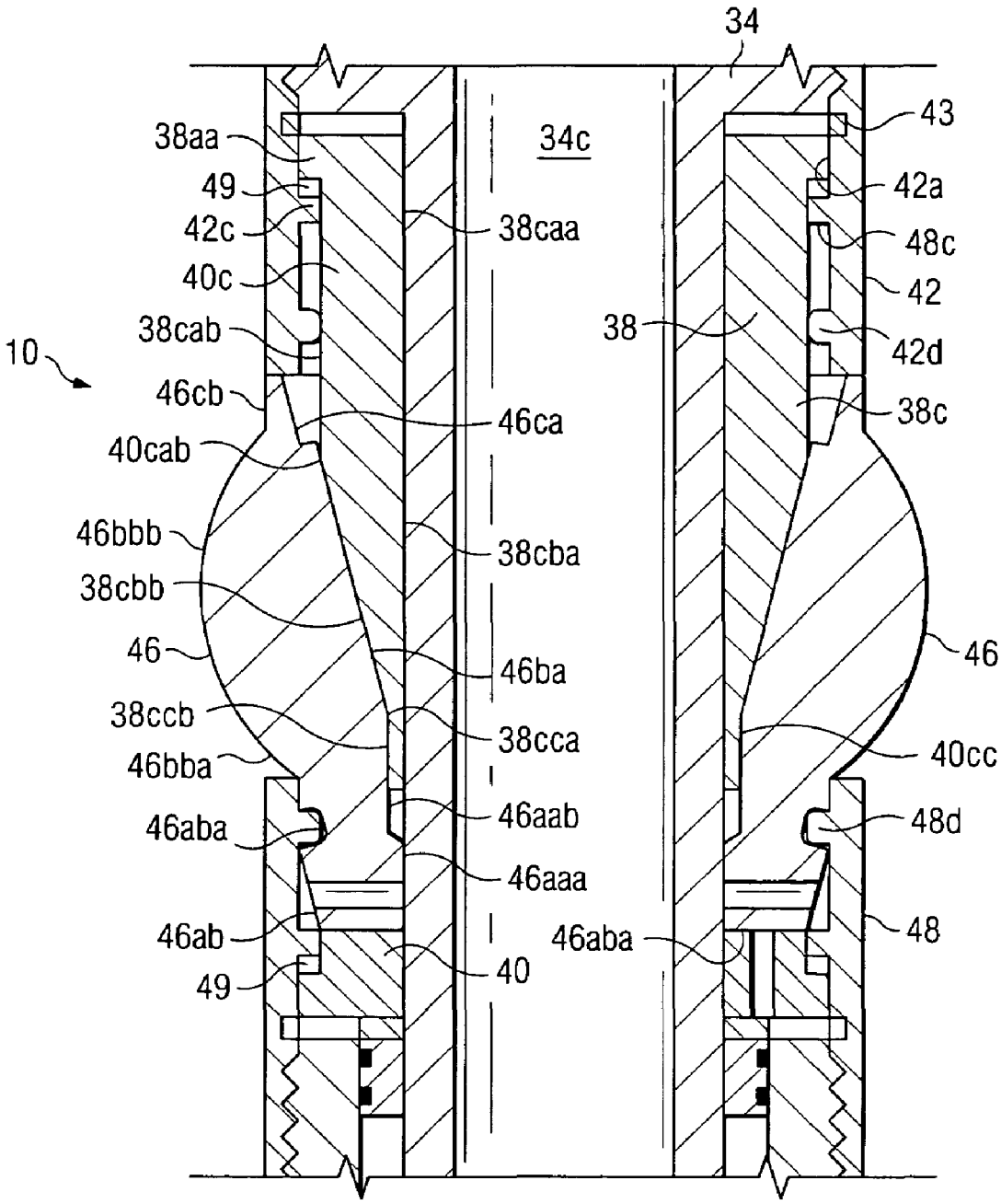
FIG. 4*a* is a fragmentary cross-sectional illustration of a portion of the apparatus of FIG. 4.
Figure 5:
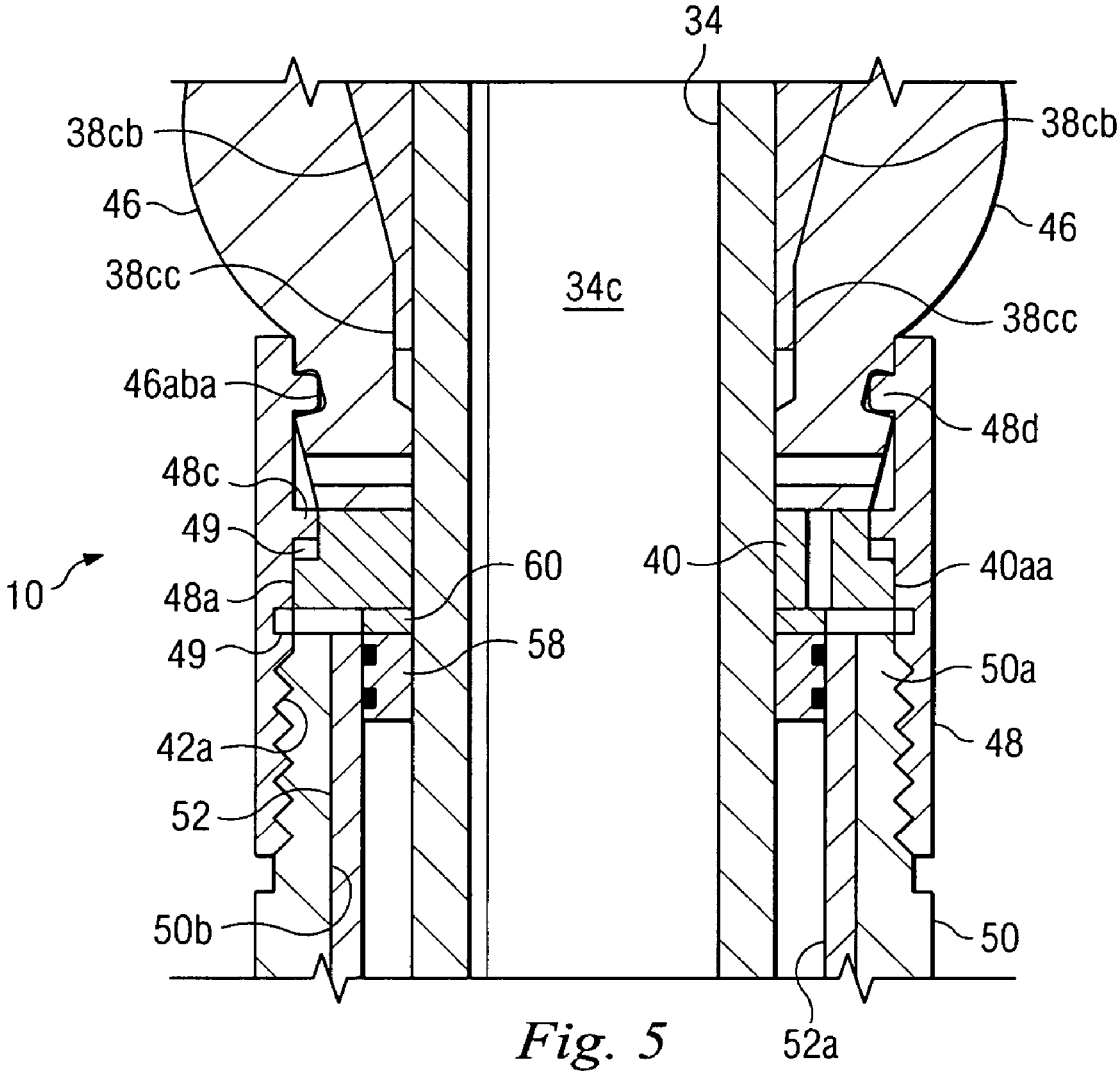
FIG. 5 is a fragmentary cross-sectional illustration of a portion of the apparatus of FIGS. 1*a* and 1*b*.
Figure 6:
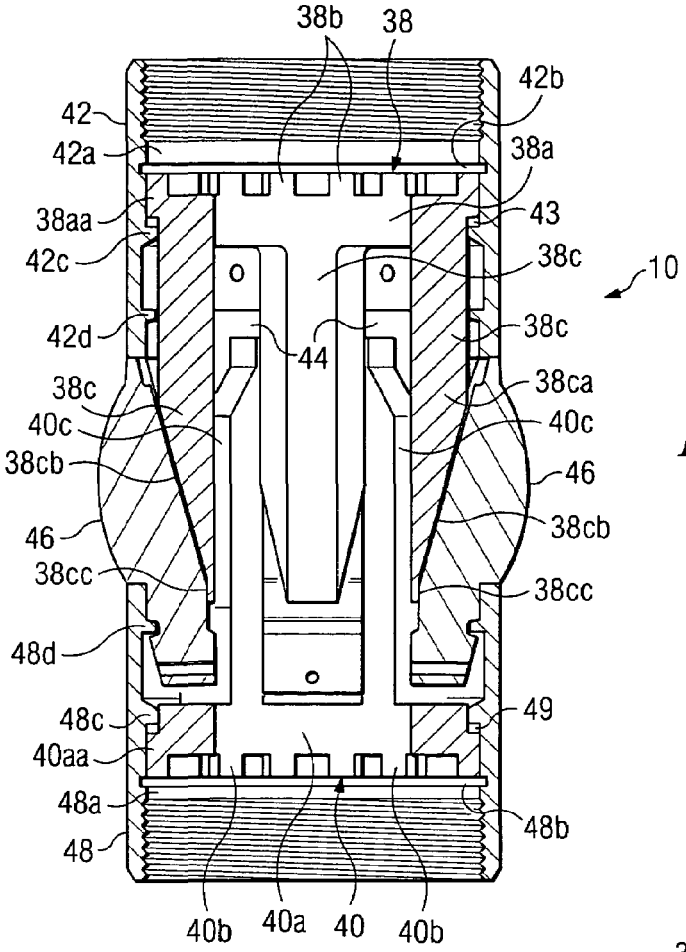
FIG. 6 is a fragmentary cross-sectional illustration of a portion of the apparatus of FIGS. 1*a* and 1*b*.
Figure 7A:
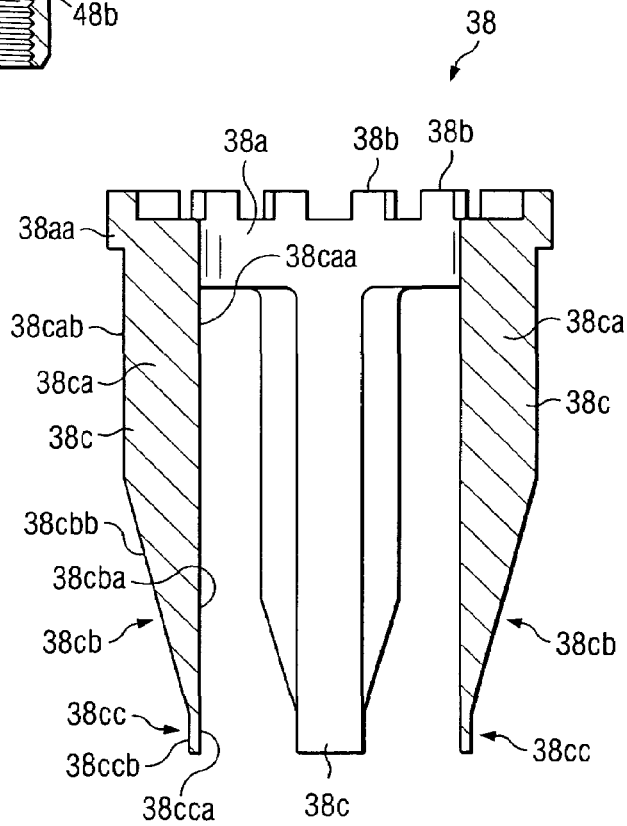
FIGS. 7*a*-7*e* are fragmentary cross-sectional and perspective illustrations of the upper cam assembly of the apparatus of FIGS. 1*a* and 1*b*.
Figure 7B:
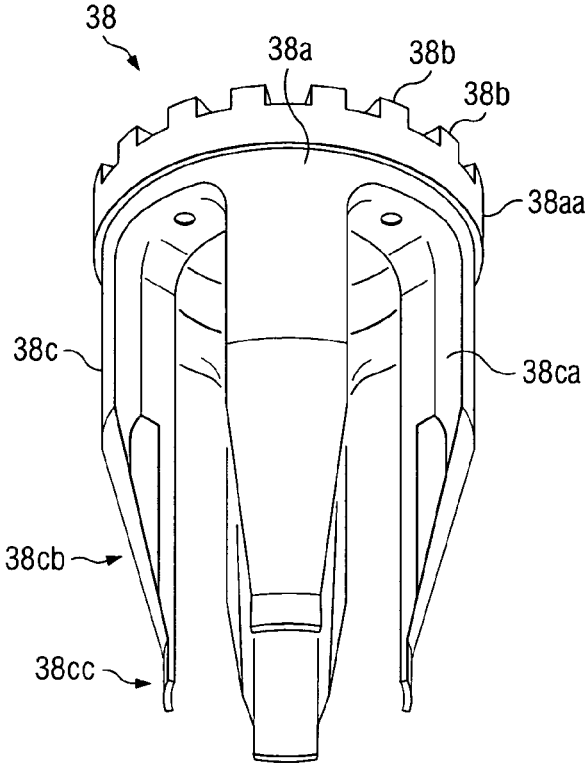
Figure 7C:
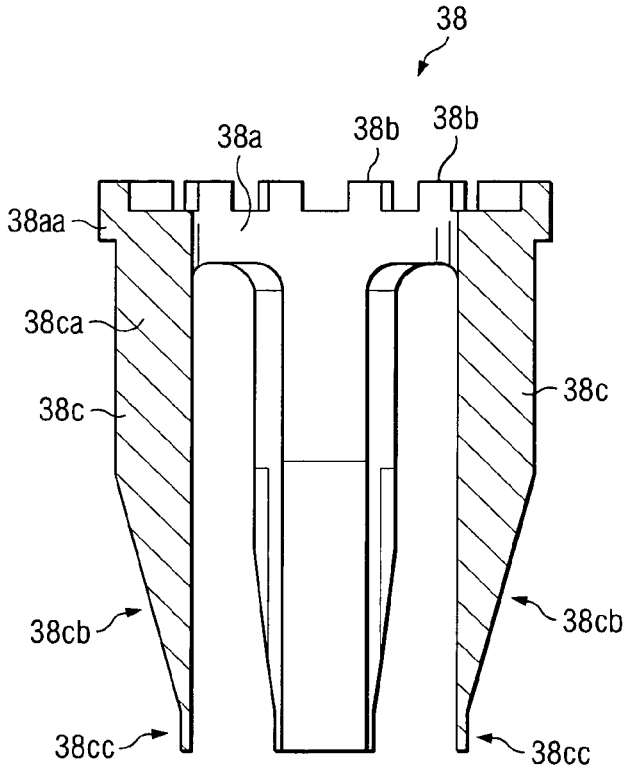
Figure 7D:
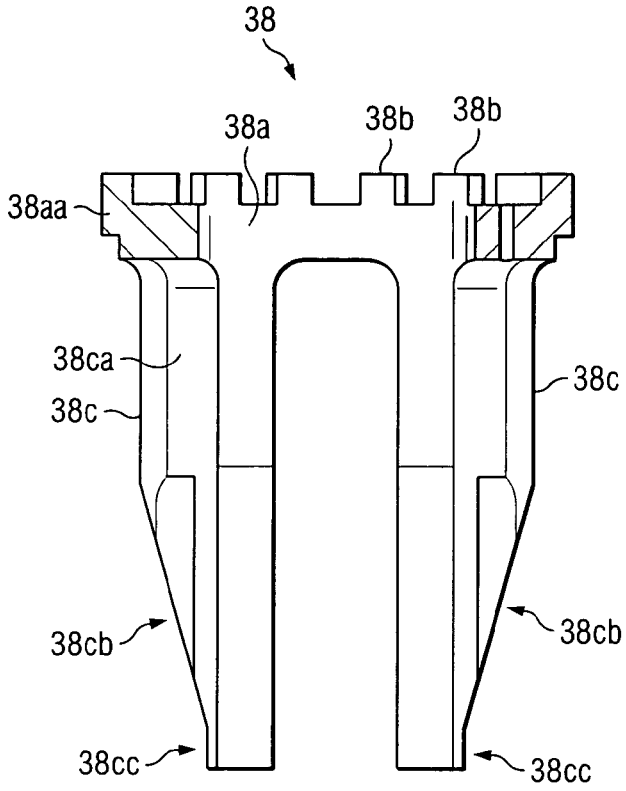
Figure 7E:
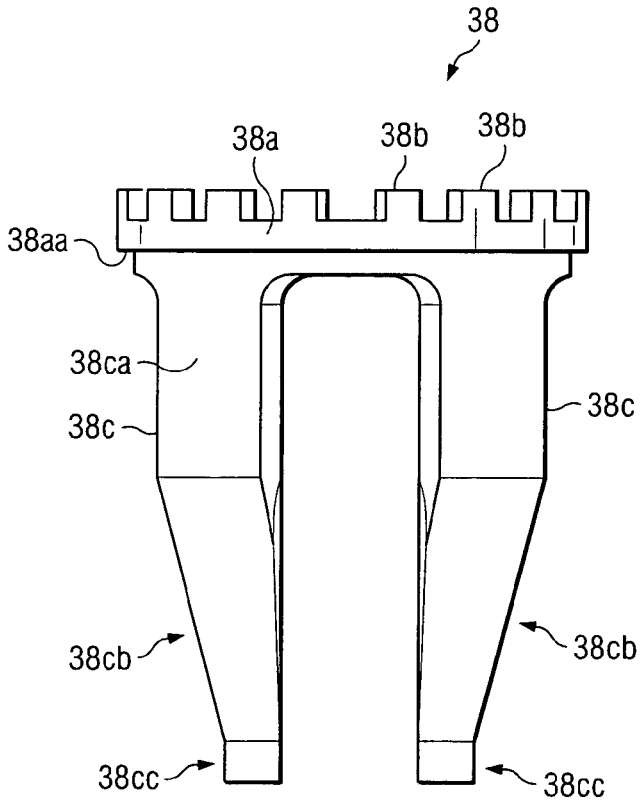
Figure 7F:
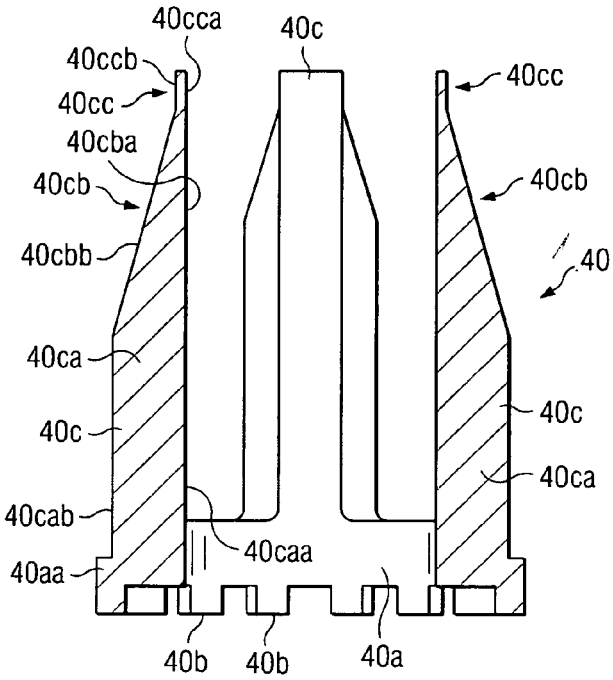
FIG. 7*f* is a fragmentary cross-sectional illustration of the lower cam assembly of the apparatus of FIGS. 1*a* and 1*b*.
Figure 8B:
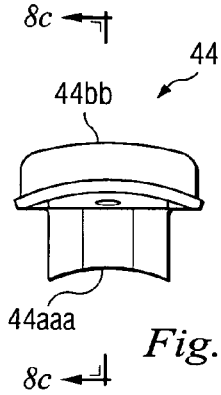
FIGS. 8*a*-8*d* are fragmentary cross-sectional and perspective illustrations of one of the upper cone segments of the apparatus of FIGS. 1*a* and 1*b*.
Figure 8A:
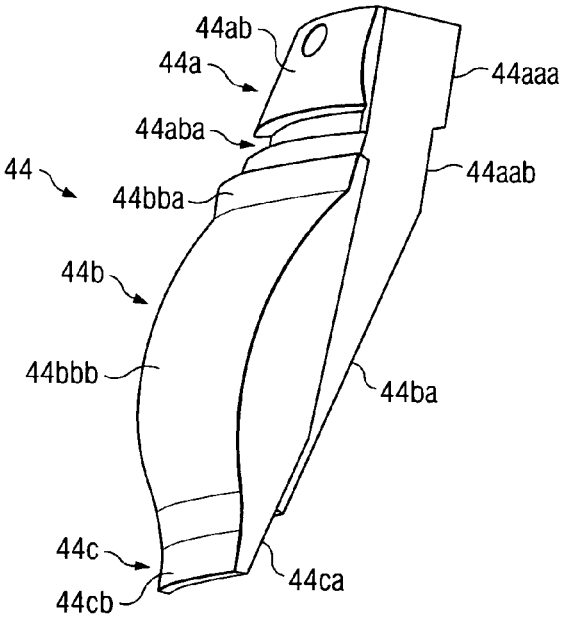
Figure 8C:
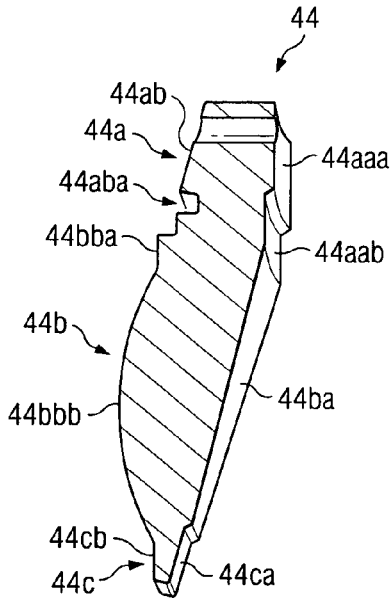
Figure 8D:
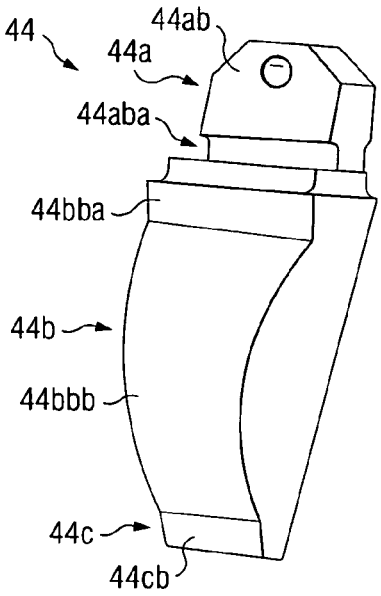
Figure 9:
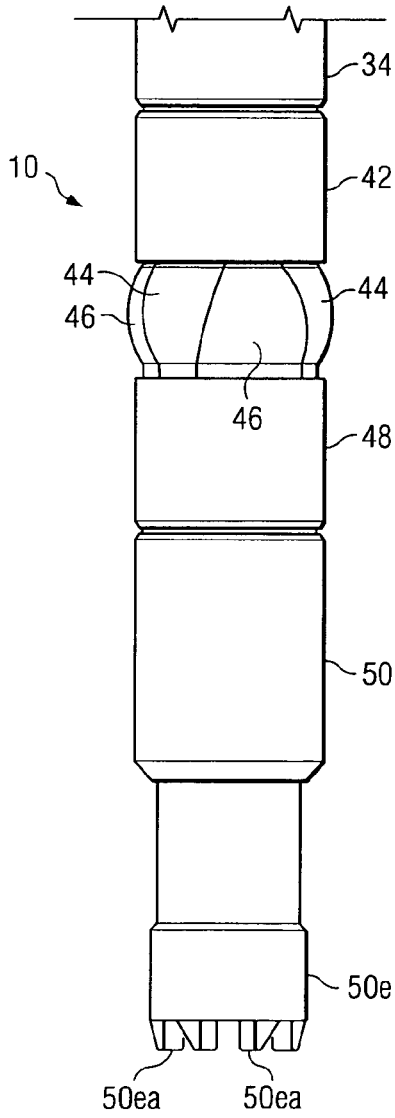
FIG. 9 is a side view of a portion of the apparatus of FIGS. 1*a* and 1*b*.
Figure 8E:
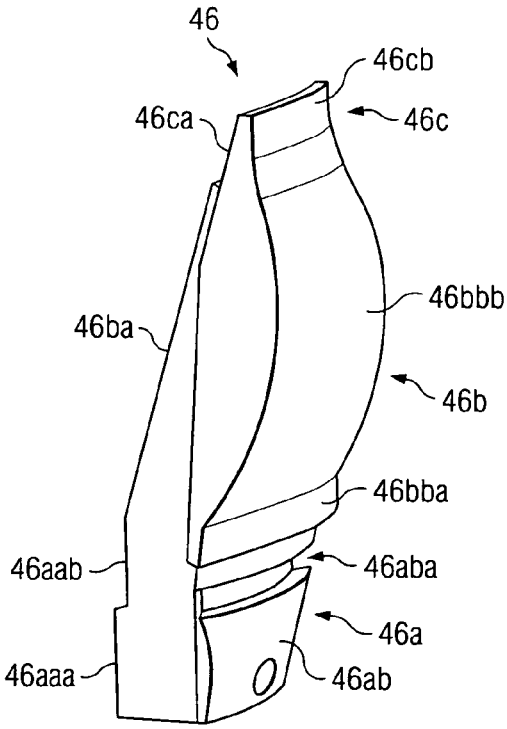
FIG. 8*e* is a fragmentary cross-sectional illustration of one of the lower cone segments of the apparatus of FIGS. 1*a* and 1*b*.

During operation, as illustrated in FIGS. 1*a* and 1*b*, the apparatus 10 is at least partially positioned within a preexisting structure such as, for example, a borehole 100 that traverses a subterranean formation that may include a preexisting wellbore casing 102. The borehole 100 may be oriented in any position, for example, from vertical to horizontal. A fluidic material 104 is then injected into the apparatus 10 through the passages 12*a*, 14*a*, 22*a*, 34*c*, 50*c*, 64*a*, and 64*b* into the annulus between the expandable tubular member 66 and the borehole 100. In an exemplary embodiment, the fluidic material 104 is a hardenable fluidic sealing material. In this manner, an annular sealing layer may be formed within the annulus between the expandable tubular member 66 and the borehole 100.

Figure 10A:
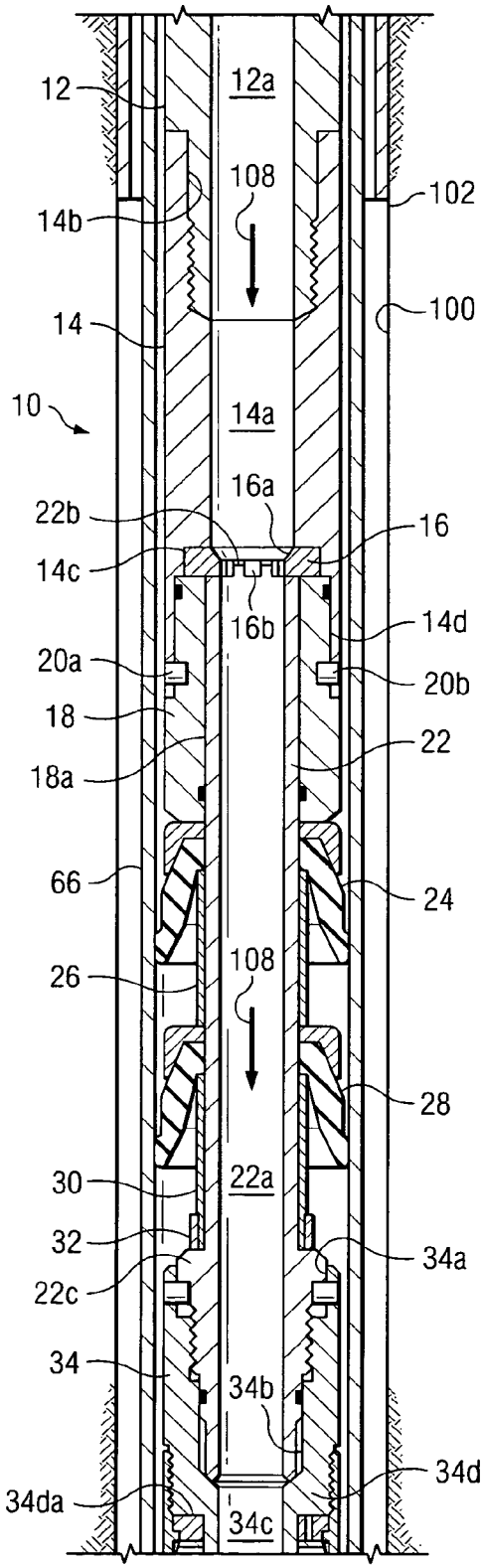
FIG. 10*a* is a fragmentary cross sectional illustration of a portion of the apparatus of FIGS. 1*a* and 1*b* during the radial expansion of the expandable tubular member.
Figure 10B:
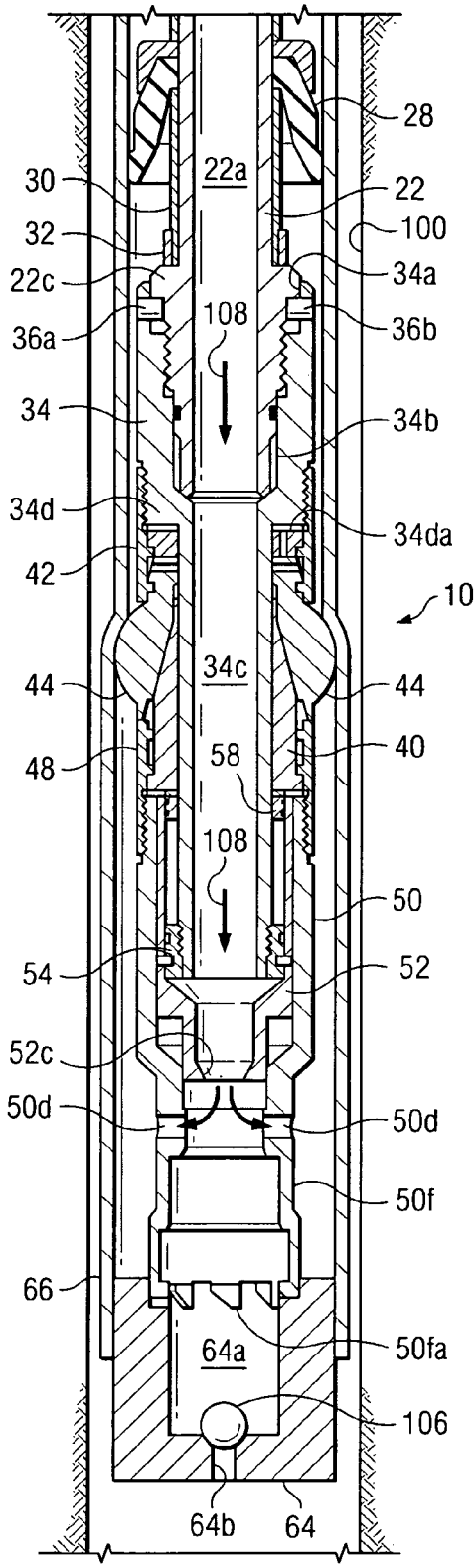
FIG. 10*b* is a fragmentary cross sectional illustration of another portion of the apparatus of FIG. 10*a*.
Figure 11A:
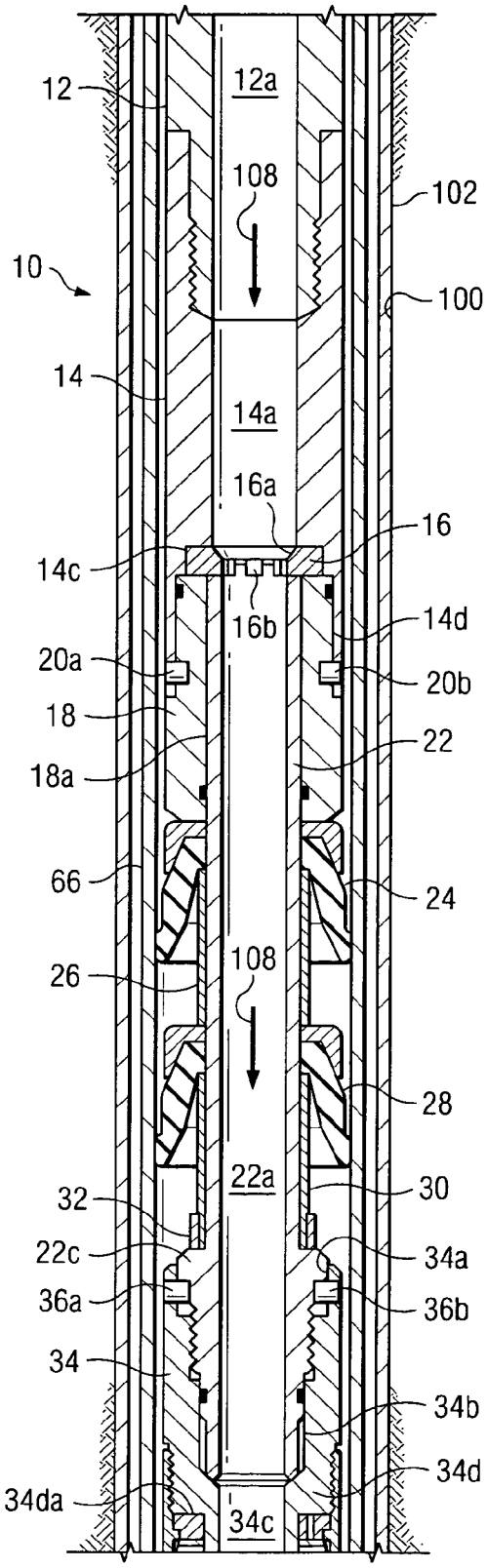
FIG. 11*a*. is a fragmentary cross sectional illustration of a portion of the apparatus of FIGS. 10*a* and 10*b* during the adjustment of the expansion cone to a collapsed position.
Figure 11B:
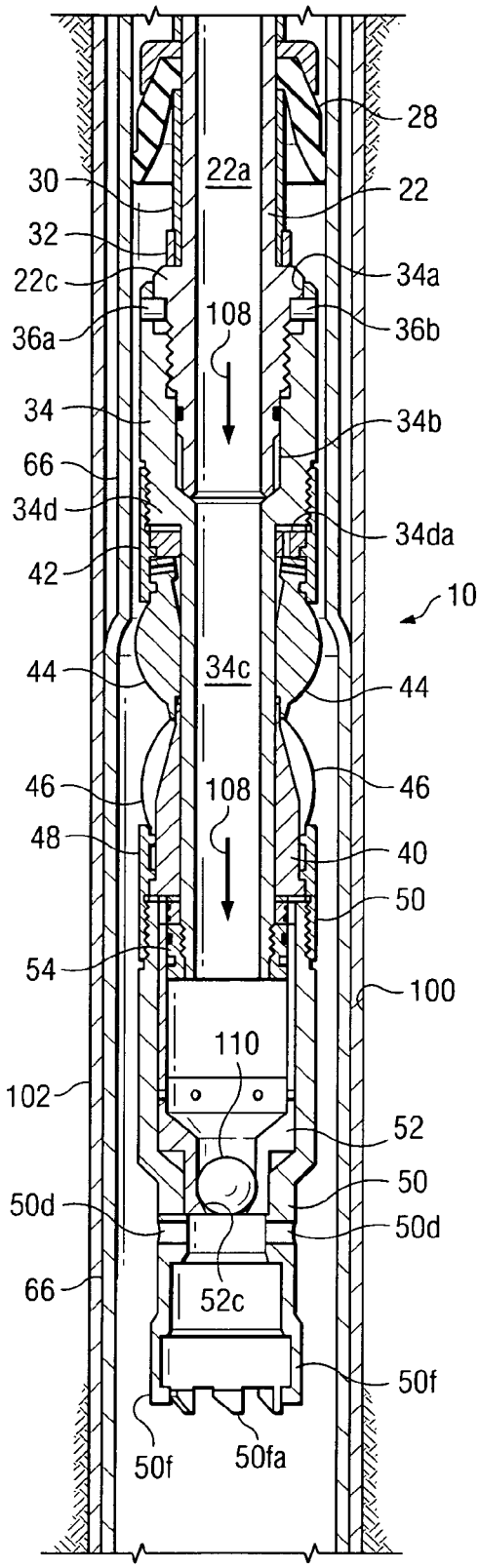
FIG. 11*b* is a fragmentary cross sectional illustration of another portion of the apparatus of FIG. 11*a*.
Figure 12:
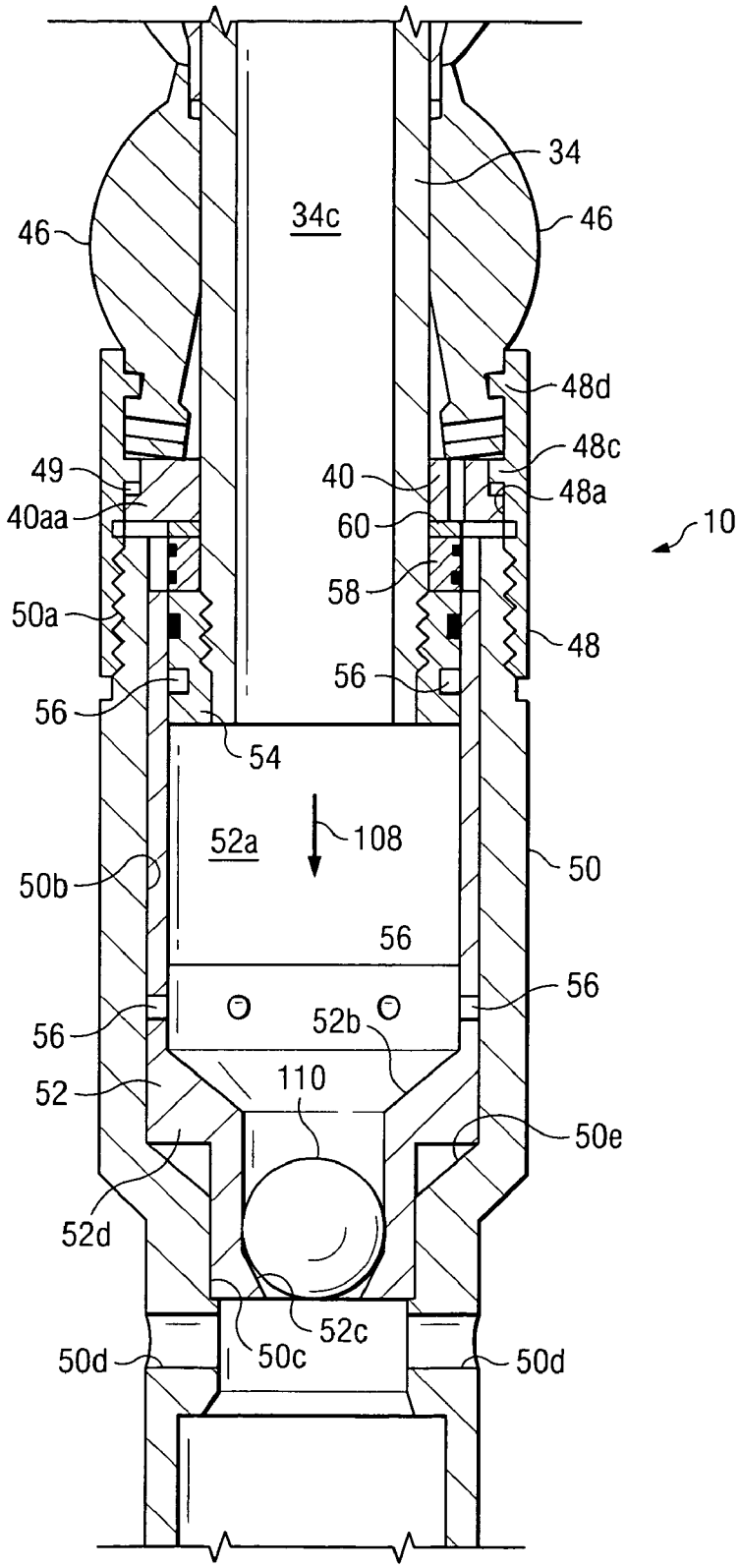
FIG. 12 is a fragmentary cross sectional illustration of a portion of the apparatus of FIGS. 11*a* and 11*b*.
Figure 13:
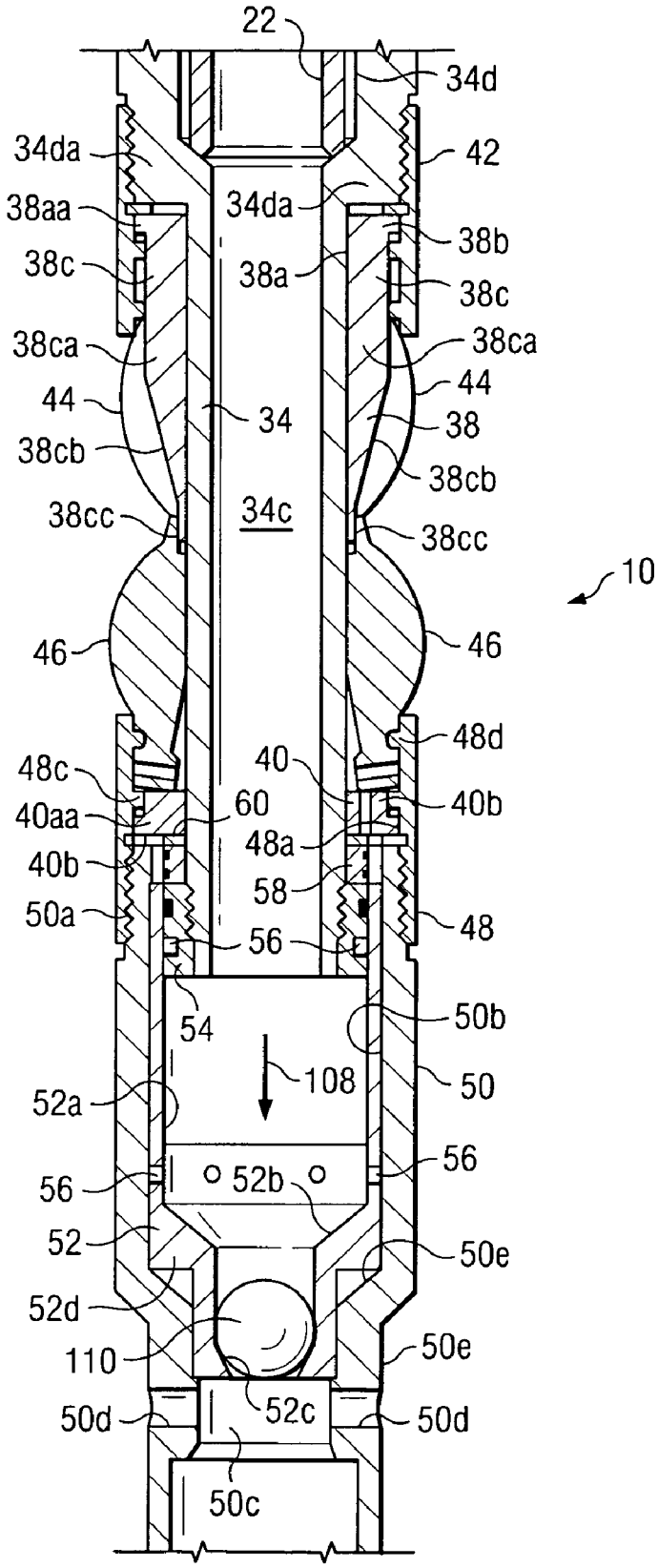
FIG. 13 is a fragmentary cross sectional illustration of a portion of the apparatus of FIGS. 11*a* and 11*b*.
Figure 14:
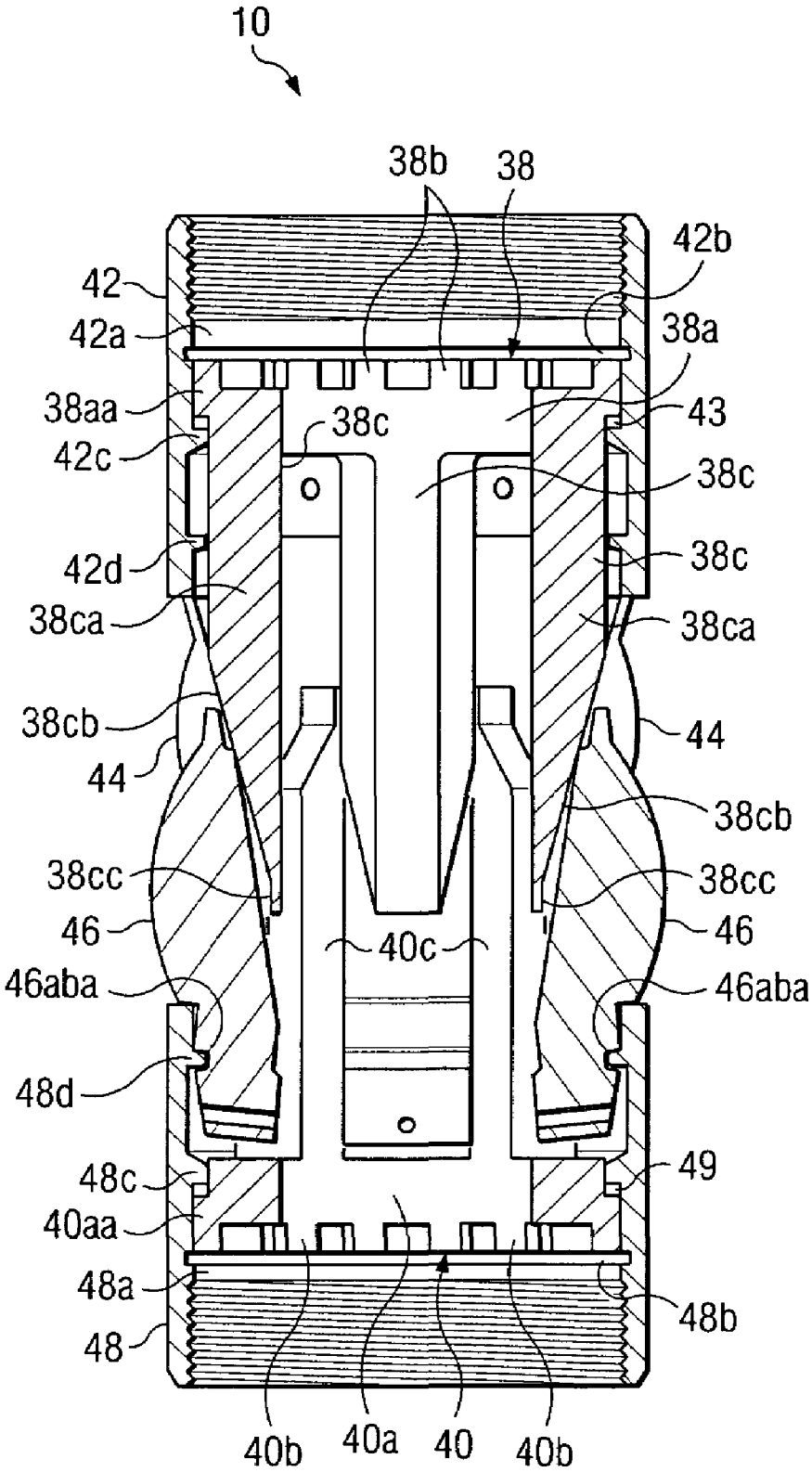
FIG. 14 is a fragmentary cross sectional illustration of a portion of the apparatus of FIGS. 11*a* and 11*b* with the expansion cone in a half collapsed position.
Figure 15:
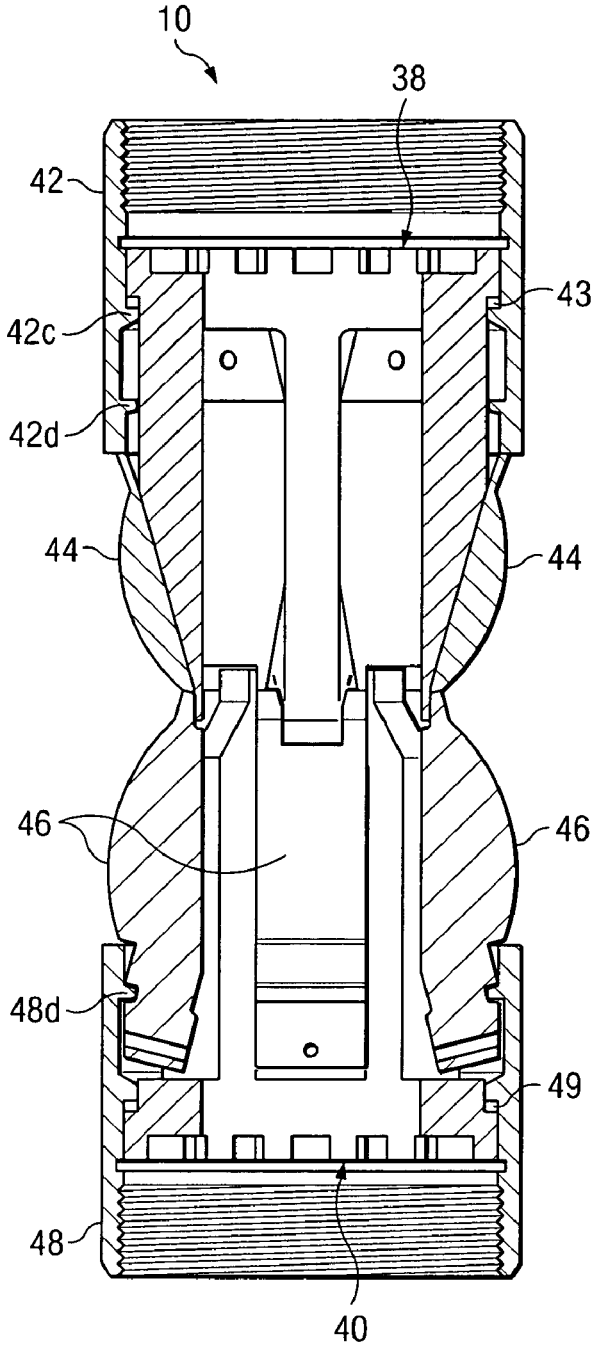
FIG. 15 is a fragmentary cross sectional illustration of a portion of the apparatus of FIGS. 11*a* and 11*b* with the expansion cone in a fully collapsed position.
Figure 16:
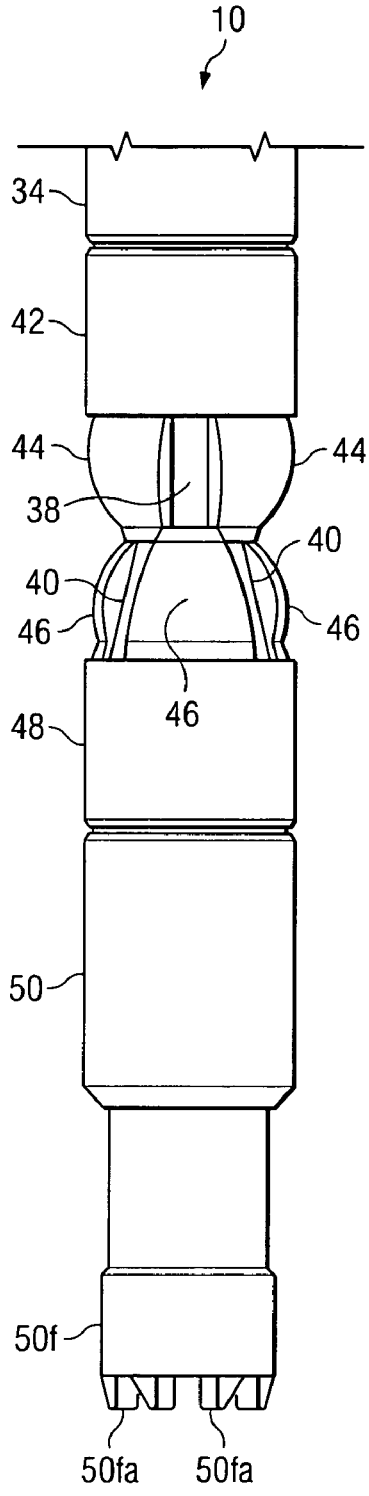
FIG. 16 is a side view of a portion of the apparatus of FIGS. 10*a* and 10*b*.

As illustrated in FIGS. 10*a* and 10*b*, a ball 106 is then be positioned within and blocking the valveable passage 64*b* of the float shoe 64 by injecting a fluidic material 108 into the apparatus 10 through the passages 12*a*, 14*a*, 22*a*, 34*c*, and 50*c*. As a result, the increased operating pressure within the passage 50*c* bursts open the burst discs 62 positioned within the radial passages 50*d* of the float shoe adaptor 50. The continued injection of the fluidic material 108 thereby pressurizes the interior of the expandable tubular member 66 below the lower packer cup 28 thereby displacing the upper and lower expansion cone segments, 44 and 46, upwardly relative to the float shoe 64 and the expandable tubular member 66. As a result, the expandable tubular member 66 is plastically deformed and radially expanded. Thus, the burst discs 62 sense the operating pressure of the injected fluidic material 108 within the passage 50*c* and thereby control the initiation of the radial expansion and plastic deformation of the expandable tubular member 66.

In an exemplary embodiment, any leakage of the pressurized fluidic material 108 past the lower packer cup 28 is captured and sealed against further leakage by the upper packer cup 24. In this manner, the lower packer cup 28 provides the primary fluidic seal against the interior surface of the expandable tubular member 66, and the upper packer cup 24 provides a secondary, back-up, fluidic seal against the interior surface of the expandable tubular member. Furthermore, because the lower packer cup 28 and/or the upper packer cup 24 provide a fluid tight seal against the interior surface of the expandable tubular member 66, the upper and lower expansion cone segments, 44 and 46, are pulled upwardly through the expandable tubular member by the axial forces created by the packer cups.

In an exemplary embodiment, during the radial expansion process, the interface between the arcuate spherical external surfaces, 44*bbb* and 46*bbb*, of the upper and lower expansion cone segments, 44 and 46, and the interior surface of the expandable tubular member 66 is not fluid tight. As a result, the fluidic material 108 may provide lubrication to the entire extent of the interface between the cylindrical external surfaces, 44*bba* and 46*cb*, and the arcuate spherical external surfaces, 44*bbb* and 46*bbb*, of the upper and lower expansion cone segments, 44 and 46, and the interior surface of the expandable tubular member 66. Moreover, experimental test results have indicated the unexpected result that the required operating pressure of the fluidic material 108 for radial expansion of the expandable tubular member 66 is less when the interface between the cylindrical external surfaces, 44*bba* and 46*cb*, and the arcuate spherical external surfaces, 44*bbb* and 46*bbb*, of the upper and lower expansion cone segments, 44 and 46, and the interior surface of the expandable tubular member 66 is not fluid tight. Furthermore, experimental test results have also demonstrated that the arcuate spherical external surface provided by the arcuate spherical external surfaces, 44*bbb* and 46*bbb*, of the upper and lower expansion cone segments, 44 and 46, provides radial expansion and plastic deformation of the expandable tubular member 66 using lower operating pressures versus an expansion cone having a conical outer surface.

In an exemplary embodiment, as illustrated in FIGS. 11*a*, 11*b*, 12, 13, 14, 15, and 16, the upper and lower expansion cone segments, 44 and 46, may then be adjusted to a collapsed position by placing a ball 110 within the ball valve seat 52*c* of the throat passage 52*b* of the retaining sleeve 52. The continued injection of the fluidic material 108, after the placement of the ball 110 within the ball valve seat 52*c*, creates a differential pressure across the ball 110 thereby applying a downward longitudinal force onto the retaining sleeve 52 thereby shearing the shear pins 56. As a result, the retaining sleeve 52 is displaced in the downward longitudinal direction relative to the float shoe adaptor 50 thereby permitting the locking dogs 58 to be displaced outwardly in the radial direction. The outward radial displacement of the locking dogs 58 disengages the locking dogs from engagement with the lower mandrel 34. Thus, the shear pins 56 sense the operating pressure of the injected fluidic material 108 within the throat passage 52*b* and thereby controlling the initiation of the collapsing of the upper and lower expansion cone segments, 44 and 46.

The continued injection of the fluidic material 108 continues to displace the retaining sleeve 52 in the downward longitudinal direction relative to the float shoe adaptor 50 until the external flange 52*d* of the retaining sleeve 52 impacts, and applies a downward longitudinal force to, the internal flange 50*e* of the float shoe adaptor. As a result, the float shoe adaptor 50 is then also displaced in the downward longitudinal direction relative to the lower mandrel 34. The downward longitudinal displacement of the float shoe adaptor 50 relative to the lower mandrel 34 causes the lower cam assembly 40, the lower expansion cone segments 46, and the lower retaining sleeve 48, which are rigidly attached to the float shoe adaptor, to also be displaced downwardly in the longitudinal direction relative to the lower mandrel 34, the upper cam assembly 38, and the upper expansion cone segments 44.

The downward longitudinal displacement of the lower cam assembly 40 relative to the upper expansion cone segments 44 causes the upper expansion cone segments to slide off of the conical external surfaces 40*cbb* of the lower cam assembly and thereby pivot inwardly in the radial direction about the internal flange 42*d* of the upper retaining sleeve 42. The downward longitudinal displacement of the lower expansion cone segments 46 relative to the upper cam assembly 38 causes the lower expansion cone segments 46 to slide off of the external conical surfaces 38*cbb* of the upper cam assembly and thereby pivot inwardly in the radial direction about the internal flange 48*d* of the lower retaining sleeve. As a result of the inward radial movement of the upper and lower expansion cone segments, 44 and 46, the arcuate external spherical surfaces, 44*bbb* and 46*bbb*, of the upper and lower expansion cone segments, 44 and 46, no longer provide a substantially contiguous outer arcuate spherical surface.

Figure 17A:
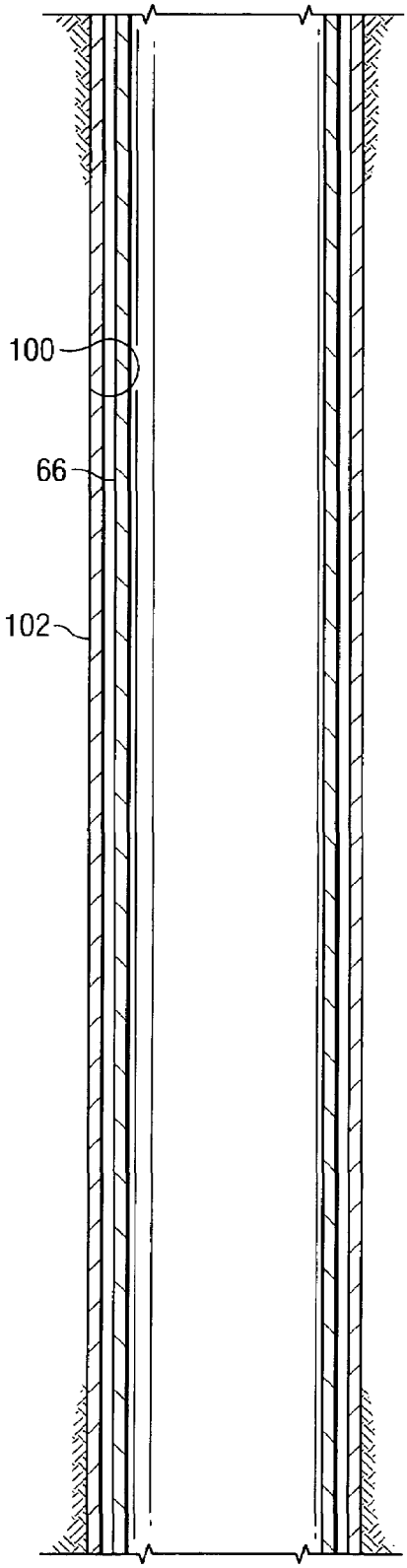
FIG. 17*a*. is a fragmentary cross sectional illustration of a portion of the apparatus of FIGS. 11*a* and 11*b* after the removal of the apparatus from interior of the expandable tubular member.
Figure 17B:
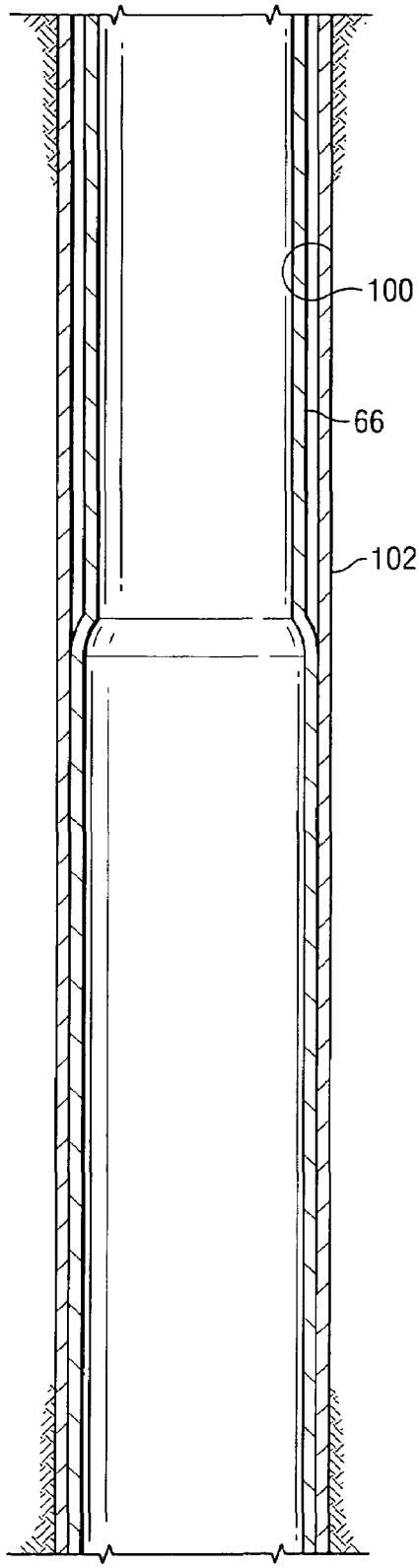
FIG. 17*b* is a fragmentary cross sectional illustration of another portion of the apparatus of FIG. 17*a*.

The downward longitudinal movement of the retaining sleeve 42 and float shoe adaptor 50 relative to the lower mandrel 34 is stopped when the stop nut 54 impacts the locking dogs 58. At this point, as illustrated in FIGS. 17*a* and 17*b*, the apparatus 10 may then be removed from the interior of the expandable tubular member 66.

Thus, the apparatus 10 may be removed from the expandable tubular member 66 prior to the complete radial expansion and plastic deformation of the expandable tubular member by controllably collapsing the upper and lower expansion cone segments, 44 and 46. As a result, the apparatus 10 provides the following benefits: (1) the apparatus is removable when expansion problems are encountered; (2) lower expansion forces are required because the portion of the expandable tubular member 66 between the packer cups, 24 and 28, and the expansion cone segments is exposed to the expansion fluid pressure; and (3) the expansion cone segments can be run down through the expandable tubular member, prior to radial expansion, and then the expansion cone segments can be expanded.

In several alternative embodiments, resilient members such as, for example, spring elements are coupled to the upper and lower expansion cone segments, 44 and 46, for resiliently biasing the expansion cone segments towards the expanded or collapsed position.

In several alternative embodiments, the placement of the upper and lower expansion cone segments, 44 and 46, in an expanded or collapsed position is reversible as disclosed in PCT patent application serial no. PCT/US02/36267, filed on Nov. 12, 2002, the disclosure of which is incorporated herein by reference.

In several alternative embodiments, a small gap is provided between the upper and lower expansion cone segments, 44 and 46, when positioned in the expanded condition that varies from about 0.005 to 0.030 inches.

An apparatus for radially expanding and plastically deforming an expandable tubular member has been described that includes an upper tubular support member defining a first passage, one or more cup seals coupled to the exterior surface of the upper tubular support member for sealing an interface between the upper tubular support member and the expandable tubular member, an upper cam assembly coupled to the upper tubular support member comprising: a tubular base coupled to the upper tubular support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the tubular support member, a lower tubular support member defining a second passage fluidicly coupled to the first passage releasably coupled to the upper tubular support member, a lower cam assembly coupled to the lower tubular support member comprising: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly, wherein the lower expansion cone segments interleave and overlap the upper expansion cone segments, and wherein the upper and lower expansion cone segments together define an arcuate spherical external surface for plastically deforming and radially expanding the expandable tubular member. In an exemplary embodiment, the upper tubular support member includes: a safety collar, a torque plate coupled to the safety collar including a plurality of circumferentially spaced apart meshing teeth at an end, an upper mandrel including a plurality of circumferentially spaced apart meshing teeth at one end for engaging the meshing teeth of the torque plate and an external flange at another end, and a lower mandrel coupled to the external flange of the upper mandrel including an external flange including a plurality of circumferentially spaced apart meshing teeth. In an exemplary embodiment, the tubular base of the upper cam assembly includes a plurality of circumferentially spaced apart meshing teeth for engaging the meshing teeth of the external flange of the lower mandrel. In an exemplary embodiment, the apparatus further includes a stop nut coupled to an end of the lower mandrel for limiting the movement of the lower tubular member relative to the lower mandrel. In an exemplary embodiment, the apparatus further includes locking dogs coupled to the lower mandrel. In an exemplary embodiment, the lower tubular support member includes: a float shoe adapter including a plurality of circumferentially spaced apart meshing teeth at one end, an internal flange, and a torsional coupling at another end, a lower retaining sleeve coupled to an end of the float shoe adapter including an internal flange for pivotally engaging the lower expansion cone segments, and a retaining sleeve received within the float shoe adapter releasably coupled to the upper tubular support member. In an exemplary embodiment, an end of the retaining sleeve abuts an end of the tubular base of the lower cam assembly. In an exemplary embodiment, the tubular base of the lower cam assembly includes a plurality of circumferentially spaced apart meshing teeth for engaging the meshing teeth of the float shoe adaptor. In an exemplary embodiment, the apparatus further includes a float shoe releasably coupled to the torsional coupling of the float shoe adaptor, and an expandable tubular member coupled to the float shoe and supported by and movably coupled to the upper and lower expansion cone segments. In an exemplary embodiment, the apparatus further includes: one or more shear pins coupled between the upper tubular support member and the lower tubular support member. In an exemplary embodiment, the apparatus further includes: a stop member coupled to the upper tubular support member for limiting movement of the upper tubular support member relative to the lower tubular support member. In an exemplary embodiment, the apparatus further includes: a float shoe releasably coupled to the lower tubular support member that defines a valveable passage, and an expandable tubular member coupled to the float shoe and supported by and movably coupled to the upper and lower expansion cone segments. In an exemplary embodiment, each upper expansion cone segment includes: an inner portion defining an arcuate cylindrical upper surface including a hinge groove for pivotally coupling the upper expansion cone segment to the upper tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, and wherein each lower expansion cone segment includes: an inner portion defining an arcuate cylindrical upper surface including a hinge groove for pivotally coupling the lower expansion cone segment to the lower tubular support member and arcuate cylindrical lower surfaces, an intermediate portion defining arcuate cylindrical and spherical upper surfaces and an arcuate conical lower surface, and an outer portion defining arcuate cylindrical upper and lower surfaces. In an exemplary embodiment, each upper expansion cone segment is tapered in the longitudinal direction from the intermediate portion to the outer portion; and wherein each lower expansion cone segment is tapered in the longitudinal direction from the intermediate portion to the outer portion.

An apparatus for radially expanding and plastically deforming an expandable tubular member has also been described that includes a safety collar, a torque plate coupled to the safety collar including a plurality of circumferentially spaced apart meshing teeth at an end, an upper mandrel including a plurality of circumferentially spaced apart meshing teeth at one end for engaging the meshing teeth of the torque plate and an external flange at another end, a lower mandrel coupled to the external flange of the upper mandrel including an external flange including a plurality of circumferentially spaced apart meshing teeth, a stop nut coupled to an end of the lower mandrel, an upper retaining sleeve coupled to the lower mandrel including an internal flange, one or more cup seals coupled to the upper mandrel for sealing an interface between the upper mandrel and the expandable tubular member, an upper cam assembly coupled to the lower mandrel including: a tubular base including a plurality of circumferentially spaced apart meshing teeth for engaging the meshing teeth of the external flange of the lower mandrel, and a plurality of cam arms extending from the tubular base in a downward longitudinal direction, each cam arm defining an inclined surface, a plurality of upper expansion cone segments interleaved with the cam arms of the upper cam assembly and pivotally coupled to the internal flange of the upper retaining sleeve, a float shoe adapter including a plurality of circumferentially spaced apart meshing teeth at one end, an internal flange, and a torsional coupling at another end, a lower retaining sleeve coupled to an end of the float shoe adapter including an internal flange, a retaining sleeve received within the float shoe adapter, one or more shear pins for releasably coupling the retaining sleeve to the stop nut, a lower cam assembly coupled to the float shoe adapter including: a tubular base including a plurality of circumferentially spaced apart meshing teeth for engaging the meshing teeth of the float shoe adapter, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, a plurality of lower expansion cone segments interleaved with cam arms of the lower cam assembly, each lower expansion cone segment pivotally coupled to the internal flange of the lower retaining sleeve and mating with the inclined surface of a corresponding one of the cam arms of the upper cam assembly, a float shoe releasably coupled to the torsional coupling of the float shoe adaptor, and an expandable tubular member coupled to the float shoe and supported by and movably coupled to the upper and lower expansion cone segments, wherein the lower expansion cone segments interleave and overlap the upper expansion cone segments, wherein the upper and lower expansion cone segments together define an arcuate spherical external surface for plastically deforming and radially expanding the expandable tubular member, wherein each upper expansion cone segment includes: an inner portion defining an arcuate cylindrical upper surface including a hinge groove for pivotally coupling the upper expansion cone segment to the upper tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, wherein each lower expansion cone segment includes: an inner portion defining an arcuate cylindrical upper surface including a hinge groove for pivotally coupling the lower expansion cone segment to the lower tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, wherein each upper expansion cone segment is tapered in the longitudinal direction from the intermediate portion to the outer portion, and wherein each lower expansion cone segment is tapered in the longitudinal direction from the intermediate portion to the outer portion.

A collapsible expansion cone assembly has also been described that includes an upper tubular support member including an internal flange, an upper cam assembly coupled to the upper tubular support member including: a tubular base coupled to the upper support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the internal flange of the upper tubular support member, a lower tubular support member including an internal flange, one or more frangible couplings for releasably coupling the upper and lower tubular support members, a lower cam assembly coupled to the lower tubular support member including: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly, wherein the lower expansion cone segments interleave and overlap the upper expansion cone segments, and wherein the upper and lower expansion cone segments together define an arcuate spherical external surface for plastically deforming and radially expanding the expandable tubular member. In an exemplary embodiment, each upper expansion cone segment includes: an inner portion defining an arcuate cylindrical upper surface including a hinge groove for pivotally coupling the upper expansion cone segment to the upper tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, and wherein each lower expansion cone segment includes: an inner portion defining an arcuate cylindrical upper surface including a hinge groove for pivotally coupling the lower expansion cone segment to the lower tubular support member and arcuate cylindrical lower surfaces, an intermediate portion defining arcuate cylindrical and spherical upper surfaces and an arcuate conical lower surface, and an outer portion defining arcuate cylindrical upper and lower surfaces. In an exemplary embodiment, each upper expansion cone segment is tapered in the longitudinal direction from the intermediate portion to the outer portion, and wherein each lower expansion cone segment is tapered in the longitudinal direction from the intermediate portion to the outer portion.

A collapsible expansion cone assembly has also been described that includes an upper tubular support member including an internal flange, an upper cam assembly coupled to the upper tubular support member including: a tubular base coupled to the upper support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the internal flange of the upper tubular support member, a lower tubular support member including an internal flange, one or more frangible couplings for releasably coupling the upper and lower tubular support members, a lower cam assembly coupled to the lower tubular support member including: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly, wherein the lower expansion cone segments interleave and overlap the upper expansion cone segments, wherein the upper and lower expansion cone segments together define an arcuate spherical external surface for plastically deforming and radially expanding the expandable tubular member, wherein each upper expansion cone segment includes: an inner portion defining an arcuate cylindrical upper surface including a hinge groove for pivotally coupling the upper expansion cone segment to the upper tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, wherein each lower expansion cone segment includes: an inner portion defining an arcuate cylindrical upper surface including a hinge groove for pivotally coupling the lower expansion cone segment to the lower tubular support member and arcuate cylindrical lower surfaces, an intermediate portion defining arcuate cylindrical and spherical upper surfaces and an arcuate conical lower surface, and an outer portion defining arcuate cylindrical upper and lower surfaces, wherein each upper expansion cone segment is tapered in the longitudinal direction from the intermediate portion to the outer portion, and wherein each lower expansion cone segment is tapered in the longitudinal direction from the intermediate portion to the outer portion.

An apparatus for radially expanding and plastically deforming an expandable tubular member has also been described that includes a tubular support member, a collapsible expansion cone coupled to the tubular support member, an expandable tubular member coupled to the collapsible expansion cone, means for displacing the collapsible expansion cone relative to the expandable tubular member, and means for collapsing the expansion cone. In an exemplary embodiment, the tubular support member includes an upper tubular support member including an internal flange and a lower tubular support member including an internal flange, wherein the expansion cone includes: an upper cam assembly coupled to the upper tubular support member including: a tubular base coupled to the upper support member, and a plurality of cam arms extending from the tubular base in a downward longitudinal direction, each cam arm defining an inclined surface, a plurality of upper expansion cone segments interleaved with the cam arms of the upper cam assembly and pivotally coupled to the internal flange of the upper tubular support member, a lower cam assembly coupled to the lower tubular support member including: a tubular base coupled to the lower tubular support member, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly; and wherein the apparatus further includes: means for releasably coupling the upper tubular support member to the lower tubular support member, and means for limiting movement of the upper tubular support member relative to the lower tubular support member. In an exemplary embodiment, the apparatus further includes: means for pivoting the upper expansion cone segments, and means for pivoting the lower expansion cone segments. In an exemplary embodiment, the apparatus further includes: means for pulling the collapsible expansion cone through the expandable tubular member.

A collapsible expansion cone has also been described that includes an upper cam assembly including: a tubular base, and a plurality of cam arms extending from the tubular base in a downward longitudinal direction, each cam arm defining an inclined surface, a plurality of upper expansion cone segments interleaved with the cam arms of the upper cam assembly, a lower cam assembly including: a tubular base, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, a plurality of lower expansion cone segments interleaved with cam arms of the lower cam assembly, each lower expansion cone segment mating with the inclined surface of a corresponding one of the cam arms of the upper cam assembly, means for moving the upper cam assembly away from the lower expansion cone segments, and means for moving the lower cam assembly away from the upper expansion cone segments. In an exemplary embodiment, the upper and lower expansion cone segments together define an arcuate spherical external surface. In an exemplary embodiment, each upper expansion cone segment includes: an inner portion defining an arcuate upper surface and arcuate cylindrical lower surfaces, an intermediate portion defining arcuate cylindrical and spherical upper surfaces and an arcuate conical lower surface, and an outer portion defining arcuate cylindrical upper and lower surfaces, and wherein each lower expansion cone segment includes: an inner portion defining an arcuate cylindrical upper surface and arcuate cylindrical lower surfaces, an intermediate portion defining arcuate cylindrical and spherical upper surfaces and an arcuate conical lower surface, and an outer portion defining arcuate cylindrical upper and lower surfaces. In an exemplary embodiment, each upper expansion cone segment is tapered in the longitudinal direction from the intermediate portion to the outer portion, and each lower expansion cone segment is tapered in the longitudinal direction from the intermediate portion to the outer portion.

A method of radially expanding and plastically deforming an expandable tubular member has also been described that includes supporting the expandable tubular member using a tubular support member and a collapsible expansion cone, injecting a fluidic material into the tubular support member, sensing the operating pressure of the injected fluidic material within a first interior portion of the tubular support member, displacing the collapsible expansion cone relative to the expandable tubular member when the sensed operating pressure of the injected fluidic material exceeds a predetermined level within the first interior portion of the tubular support member, sensing the operating pressure of the injected fluidic material within a second interior portion of the tubular support member, and collapsing the collapsible expansion cone when the sensed operating pressure of the injected fluidic material exceeds a predetermined level within the second interior portion of the tubular support member. In an exemplary embodiment, the method further includes: pulling the collapsible expansion cone through the expandable tubular member when the sensed operating pressure of the injected fluidic material exceeds a predetermined level within the first interior portion of the tubular support member. In an exemplary embodiment, pulling the collapsible expansion cone through the expandable tubular member includes: coupling one or more cup seals to the tubular support member above the collapsible expansion cone, pressuring the interior of the expandable tubular member below the cup seals, and pulling the collapsible expansion cone through the expandable tubular member using the cup seals. In an exemplary embodiment, the tubular support member includes an upper tubular support member and a lower tubular support member, and wherein collapsing the collapsible expansion cone includes displacing the upper tubular member relative to the lower tubular support member. In an exemplary embodiment, the collapsible expansion cone includes: an upper cam assembly including: a tubular base, and a plurality of cam arms extending from the tubular base in a downward longitudinal direction, each cam arm defining an inclined surface, a plurality of upper expansion cone segments interleaved with the cam arms of the upper cam assembly and pivotally coupled to the upper tubular support member, a lower cam assembly including: a tubular base, and a plurality of cam arms extending from the tubular base in an upward longitudinal direction, each cam arm defining an inclined surface that mates with the inclined surface of a corresponding one of the upper expansion cone segments, wherein the cams arms of the upper cam assembly are interleaved with and overlap the cam arms of the lower cam assembly, and a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, the expansion surfaces of the expansion cone segments may include any form of inclined surface or combination of inclined surface such as, for example, conical, spherical, elliptical, and/or parabolic.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for radially expanding and plastically deforming an expandable tubular member, comprising:

an upper tubular support member defining a first passage;

one or more cup seals coupled to the exterior surface of the upper tubular support member for sealing an interface between the upper tubular support member and the expandable tubular member;

an upper cam assembly coupled to the upper tubular support member comprising:

a tubular base coupled to the upper tubular support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the tubular support member;

a lower tubular support member defining a second passage fluidicly coupled to the first passage releasably coupled to the upper tubular support member;

a lower cam assembly coupled to the lower tubular support member comprising:

a tubular base coupled to the lower tubular support member; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly;

wherein the lower expansion cone segments interleave and overlap the upper expansion cone segments; and wherein the upper and lower expansion cone segments together define an arcuate spherical external surface for plastically deforming and radially expanding the expandable tubular member.

2. The apparatus of claim 1, wherein the upper tubular support member comprises:

a safety collar;

a torque plate coupled to the safety collar comprising a plurality of circumferentially spaced apart meshing teeth at an end;

an upper mandrel comprising a plurality of circumferentially spaced apart meshing teeth at one end for engaging the meshing teeth of the torque plate and an external flange at another end; and a lower mandrel coupled to the external flange of the upper mandrel comprising an external flange comprising a plurality of circumferentially spaced apart meshing teeth.

3. The apparatus of claim 2, wherein the tubular base of the upper cam assembly comprises a plurality of circumferentially spaced apart meshing teeth for engaging the meshing teeth of the external flange of the lower mandrel.

4. The apparatus of claim 2, further comprising:

a stop nut coupled to an end of the lower mandrel for limiting the movement of the lower tubular member relative to the lower mandrel.

5. The apparatus of claim 2, further comprising:

locking dogs coupled to the lower mandrel.

6. The apparatus of claim 1, wherein the lower tubular support member comprises:

a float shoe adapter comprising a plurality of circumferentially spaced apart meshing teeth at one end, an internal flange, and a torsional coupling at another end;

a lower retaining sleeve coupled to an end of the float shoe adapter comprising an internal flange for pivotally engaging the lower expansion cone segments; and a retaining sleeve received within the float shoe adapter releasably coupled to the tipper tubular support member.

7. The apparatus of claim 6, wherein an end of the retaining sleeve abuts an end of the tubular base of the lower cam assembly.

8. The apparatus of claim 6, wherein the tubular base of the lower cam assembly comprises a plurality of circumferentially spaced apart meshing teeth for engaging the meshing teeth of the float shoe adaptor.

9. The apparatus of claim 6, further comprising:

a float shoe releasably coupled to the torsional coupling of the float shoe adaptor; and an expandable tubular member coupled to the float shoe and supported by and movably coupled to the upper and lower expansion cone segments.

10. The apparatus of claim 1, further comprising:

one or more shear pins coupled between the upper tubular support member and the lower tubular support member.

11. The apparatus of claim 1, further comprising:

a stop member coupled to the upper tubular support member for limiting movement of the upper tubular support member relative to the lower tubular support member.

12. The apparatus of claim 1, further comprising:

a float shoe releasably coupled to the lower tubular support member that defines a valveable passage; and an expandable tubular member coupled to the float shoe and supported by and movably coupled to the upper and lower expansion cone segments.

13. The apparatus of claim 1, wherein each upper expansion cone segment comprises:

an inner portion defining an arcuate cylindrical upper surface including a hinge groove for pivotally coupling the upper expansion cone segment to the upper tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces; and wherein each lower expansion cone segment comprises:

an inner portion defining an arcuate cylindrical upper surface including a hinge groove for pivotally coupling the lower expansion cone segment to the lower tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces.

14. The apparatus of claim 13, wherein each upper expansion cone segment is tapered in the longitudinal direction from the intermediate portion to the outer portion; and wherein each lower expansion cone segment is tapered in the longitudinal direction from the intermediate portion to the outer portion.

15. An apparatus for radially expanding and plastically deforming an expandable tubular member, comprising:

a safety collar;

a torque plate coupled to the safety collar comprising a plurality of circumferentially spaced apart meshing teeth at an end;

an upper mandrel comprising a plurality of circumferentially spaced apart meshing teeth at one end for engaging the meshing teeth of the torque plate and an external flange at another end;

a lower mandrel coupled to the external flange of the upper mandrel comprising an external flange comprising a plurality of circumferentially spaced apart meshing teeth;

a stop nut coupled to an end of the lower mandrel;

an upper retaining sleeve coupled to the lower mandrel comprising an internal flange;

one or more cup seals coupled to the upper mandrel for sealing an interface between the upper mandrel and the expandable tubular member;

an upper cam assembly coupled to the lower mandrel comprising:

a tubular base comprising a plurality of circumferentially spaced apart meshing teeth for engaging the meshing teeth of the external flange of the lower mandrel; and a plurality of cam arms extending from the tubular base in a downward longitudinal direction, each cam arm defining an inclined surface;

a plurality of upper expansion cone segments interleaved wit the cam arms of the upper cam assembly and pivotally coupled to the internal flange of the upper retaining sleeve;

a float shoe adapter comprising a plurality of circumferentially spaced apart meshing teeth at one end, an internal flange, and a torsional coupling at another end;

a lower retaining sleeve coupled to an end of the float shoe adapter comprising an internal flange;

a retaining sleeve received within the float shoe adapter; one or more shear pins for releasably coupling the retaining sleeve to the stop nut;

a lower cam assembly coupled to the float shoe adapter comprising:

a tubular base comprising a plurality of circumferentially spaced apart meshing teeth for engaging the meshing teeth of the float shoe adapter; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly;

a plurality of lower expansion cone segments interleaved with cam arms of the lower cam assembly, each lower expansion cone segment pivotally coupled to the internal flange of the lower retaining sleeve and mating with the inclined surface of a corresponding one of the cam arms of the upper cam assembly;

a float shoe releasably coupled to the torsional coupling of the float shoe adaptor; and an expandable tubular member coupled to the float shoe and supported by and movably coupled to the upper and lower expansion cone segments;

wherein the lower expansion cone segments interleave and overlap the upper expansion cone segments;

wherein the upper and lower expansion cone segments together define an arcuate spherical external surface for plastically deforming and radially expanding the expandable tubular member;

wherein each upper expansion cone segment comprises:

an inner portion defining an arcuate cylindrical upper surface including a hinge groove for pivotally coupling the upper expansion cone segment to the upper tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces;

wherein each lower expansion cone segment comprises:

an inner portion defining an arcuate cylindrical upper surface including a hinge groove for pivotally coupling the lower expansion cone segment to the lower tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces;

wherein each upper expansion cone segment is tapered in the longitudinal direction from the intermediate portion to the outer portion; and wherein each lower expansion cone segment is tapered in the longitudinal direction from the intermediate portion to the outer portion.

16. A collapsible expansion cone assembly comprising:

an upper tubular support member comprising an internal flange;

an upper cam assembly coupled to the upper tubular support member comprising:

a tubular base coupled to the upper support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the internal flange of the upper tubular support member;

a lower tubular support member comprising an internal flange;

one or more frangible couplings for releasably coupling the upper and lower tubular support members;

a lower cam assembly coupled to the lower tubular support member comprising:

a tubular base coupled to the lower tubular support member; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly;

wherein the lower expansion cone segments interleave and overlap the upper expansion cone segments; and wherein the upper and lower expansion cone segments together define an arcuate spherical external surface for plastically deforming and radially expanding the expandable tubular member.

17. The assembly of claim 16, wherein each upper expansion cone segment comprises:

an inner portion defining an arcuate cylindrical upper surface including a hinge groove for pivotally coupling the upper expansion cone segment to the upper tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces; and wherein each lower expansion cone segment comprises:

an inner portion defining an arcuate cylindrical upper surface including a hinge groove for pivotally coupling the lower expansion cone segment to the lower tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces.

18. The assembly of claim 16, wherein each upper expansion cone segment is tapered in the longitudinal direction from the intermediate portion to the outer portion; and wherein each lower expansion cone segment is tapered in the longitudinal direction from the intermediate portion to the outer portion.

19. A collapsible expansion cone assembly, comprising:

upper tubular support member comprising an internal flange;

an upper earn assembly coupled to the upper tubular support member comprising:

a tubular base coupled to the upper support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the internal flange of the upper tubular support member;

a lower tubular support member comprising an internal flange;

one or more frangible couplings for releasably coupling the upper and lower tubular support members;

a lower cam assembly coupled to the lower tubular support member comprising:

a tubular base coupled to the lower tubular support member; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly;

wherein the lower expansion cone segments interleave and overlap the upper expansion cone segments;

wherein the upper and lower expansion cone segments together define an arcuate spherical external surface for plastically deforming and radially expanding the expandable tubular member;

wherein each upper expansion cone segment comprises:

an inner portion defining an arcuate cylindrical upper surface including a hinge groove for pivotally coupling the upper expansion cone segment to the upper tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces;

wherein each lower expansion cone segment comprises:

an inner portion defining an arcuate cylindrical upper surface including a binge groove for pivotally coupling the lower expansion cone segment to the lower tabular support member and arcuate cylindrical lower surfaces;

an intermediate portion defining arcuate cylindrical and spherical upper surfaces and an arcuate conical lower surface; and an outer portion defining arcuate cylindrical upper and lower surfaces;

wherein each upper expansion cone segment is tapered in the longitudinal direction from the intermediate portion to the outer portion; and wherein each lower expansion cone segment is tapered in the longitudinal direction from the intermediate portion to the outer portion.

20. An apparatus for radially expanding and plastically deforming an expandable tubular member, comprising:

a tubular support member;

a collapsible expansion cone coupled to the tubular support member;

an expandable tubular member coupled to the collapsible expansion cone; means for displacing the collapsible expansion cone relative to the expandable tubular member; and means for collapsing the expansion cone;

wherein the tubular support member comprises an upper tubular support member comprising an internal flange and a lower tubular support member comprising an internal flange; wherein the expansion cone comprises:

an upper cam assembly coupled to the upper tubular support member comprising:

a tubular base coupled to the upper support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the internal flange of the upper tubular support member;

a lower cam assembly coupled to the lower tubular support member comprising:

a tubular base coupled to the lower tubular support member; and a plurality of cam arms extending from the tubular base in an upward longitudinal direction, each earn arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly; and wherein the apparatus further comprises:

means for releasably coupling the upper tubular support member to the lower tubular support member; and means for limiting movement of the upper tubular support member relative to the lower tubular support member.

21. The apparatus of claim 20, further comprising:

means for pivoting the upper expansion cone segments; and means for pivoting the lower expansion cone segments.

22. A collapsible expansion cone, comprising:

an upper cam assembly comprising:

a tubular base; and a plurality of cam arms extending from the tubular base in a downward longitudinal direction, each cam arm defining an inclined surface;

a plurality of upper expansion cone segments interleaved with the cam arms of the upper cam assembly;

a lower cam assembly comprising:

a tubular base; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly;

a plurality of lower expansion cone segments interleaved with cam arms of the lower cam assembly, each lower expansion cone segment mating with the inclined surface of a corresponding one of the cam arms of the upper cam assembly;

means for moving the upper cam assembly away from the lower expansion cone segments; and means for moving the lower cam assembly away from the upper expansion cone segments.

23. The apparatus of claim 22, wherein the upper and lower expansion cone segments together define an arcuate spherical external surface.

24. The apparatus of claim 22, wherein each upper expansion cone segment comprises:

an inner portion defining an arcuate cylindrical upper surface and arcuate cylindrical lower surfaces;

an intermediate portion defining arcuate cylindrical and spherical upper surfaces and an arcuate conical lower surface; and an outer portion defining arcuate cylindrical upper and lower surfaces; and wherein each lower expansion cone segment comprises:

an inner portion defining an arcuate cylindrical upper surface and arcuate cylindrical lower surfaces;

an intermediate portion defining arcuate cylindrical and spherical upper surfaces and an arcuate conical lower surface; and an outer portion defining arcuate cylindrical upper and lower surfaces.

25. The apparatus of claim 22, wherein each upper expansion cone segment is tapered in the longitudinal direction from the intermediate portion to the outer portion; and wherein each lower expansion cone segment is tapered in the longitudinal direction from the intermediate portion to the outer portion.

26. A method of radially expanding and plastically deforming an expandable tubular member, comprising:

supporting the expandable tubular member using a tubular support member and a collapsible expansion cone;

injecting a fluidic material into the tubular support member;

sensing the operating pressure of the in injected fluidic material within a first interior portion of the tubular support member;

displacing the collapsible expansion cone relative to the expandable tubular member when the sensed operating pressure of the injected fluidic material exceeds a predetermined level within the first interior portion of the tubular support member;

sensing the operating pressure of the injected fluidic material within a second interior portion of the tubular support member; and collapsing the collapsible expansion cone when the sensed operating pressure of the injected fluidic material exceeds a predetermined level within the second interior portion of the tubular support member.

27. The method of claim 26, further comprising:

pulling the collapsible expansion cone through the expandable tubular member when the sensed operating pressure of the injected fluidic material exceeds a predetermined level within the first interior portion of the tubular support member.

28. The method of claim 27, wherein pulling the collapsible expansion cone through the expandable tubular member comprises:

coupling one or more cup seals to the tubular support member above the collapsible expansion cone;

pressuring the interior of the expandable tubular member below the cup seals; and pulling the collapsible expansion cone through the expandable tubular member using the cup seals.

29. The method of claim 26, wherein the tubular support member comprises an upper tubular support member and a lower tubular support member; and wherein collapsing the collapsible expansion cone comprises displacing the upper tubular member relative to the lower tubular support member.

30. The method of claim 29, wherein the collapsible expansion cone comprises:

an upper cam assembly comprising:

a tubular base; and a plurality of cam arms extending from the tubular base in a downward longitudinal direction, each cam arm defining an inclined surface;

a plurality of upper expansion cone segments interleaved with the cam arms of the upper cam assembly and pivotally coupled to the upper tubular support member;

a lower cam assembly comprising:

a tubular base; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly.

31. An apparatus for radially expanding and plastically deforming an expandable tubular member, comprising:

an upper tubular support member defining a first passage;

one or more cup seals coupled to the exterior surface of the upper tubular support member for sealing an interface between the upper tubular support member and the expandable tubular member; and an adjustable expansion device coupled to the upper tubular support member adapted to be controllably adjusted between a smaller outside diameter and a larger outside diameter;

wherein the adjustable expansion device comprises:

an upper cam assembly coupled to the upper tubular support member comprising:

a tubular base coupled to the upper tubular support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the upper tubular support member;

a lower tubular support member defining a second passage fluidicly coupled to the first passage releasably coupled to the upper tubular support member;

a lower cam assembly coupled to the lower tubular support member comprising:

a tubular base coupled to the lower tubular support member; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the lower tubular support member and mating with the inclined surface of a corresponding one of the cam arms of the upper cam assembly.

32. The apparatus of claim 31, wherein the lower expansion cone segments interleave and overlap the upper expansion cone segments; and wherein the upper and lower expansion cone segments together define an arcuate spherical external surface for plastically deforming and radially expanding the expandable tubular member.

33. A collapsible expansion cone assembly comprising:

an upper tubular support member comprising an internal flange;

an upper earn assembly coupled to the upper tubular support member comprising:

a tubular base coupled to the upper support member; and a plurality of cam arms extending from the tubular base in a downward longitudinal direction, each cam arm defining an inclined surface;

a plurality of upper expansion cone segments interleaved with the cam arms of the upper cam assembly and pivotally coupled to the internal flange of the upper tubular support member;

a lower tubular support member comprising an internal flange;

a lower cam assembly coupled to the lower tubular support member comprising:

a tubular base coupled to the lower tabular support member; and a plurality of cam arms extending from the tubular base in an upward longitudinal direction, each cam arm defining an inclined surface that mates with the inclined surface of a corresponding one of the upper expansion cone segments;

wherein the cams arms of the upper cam assembly are interleaved with and overlap the cam arms of the lower cam assembly; and a plurality of lower expansion cone segments interleaved with cam arms of the lower cam assembly, each lower expansion cone segment pivotally coupled to the internal flange of the lower tubular support member and mating with the inclined surface of a corresponding one of the cam arms of the upper cam assembly;

wherein the lower expansion cone segments interleave and overlap the upper expansion cone segments.

34. The assembly of claim 33, wherein the upper and lower expansion cone segments together define an arcuate spherical external surface for plastically deforming and radially expanding the expandable tubular member.

35. The assembly of claim 33, wherein each upper expansion cone segment comprises:

an inner portion defining an arcuate cylindrical upper surface including a hinge groove for pivotally coupling the upper expansion cone segment to the upper tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces; and wherein each lower expansion cone segment comprises:

an inner portion defining an arcuate cylindrical upper surface including a hinge groove for pivotally coupling the lower expansion cone segment to the lower tubular support member and arcuate cylindrical lower surfaces;

an intermediate portion defining arcuate cylindrical and spherical upper surfaces and an arcuate conical lower surface; and an outer portion defining arcuate cylindrical upper and lower surfaces.

36. The assembly of claim 33, wherein each upper expansion cone segment is tapered in the longitudinal direction from the intermediate portion to the outer portion; and wherein each lower expansion cone segment is tapered in the longitudinal direction from the intermediate portion to the outer portion.

37. A method of radially expanding and plastically deforming an expandable tubular member, comprising:

supporting the expandable tubular member using a tubular support member and an adjustable expansion device;

injecting a fluidic material into the tubular support member;

sensing the operating pressure of the injected fluidic material within a first interior portion of the tubular support member;

displacing the adjustable expansion device relative to the expandable tubular member when the sensed operating pressure of the injected fluidic material exceeds a predetermined level within the first interior portion of the tubular support member;

sensing the operating pressure of the injected fluidic material within a second interior portion of the tubular support member; and reducing the outside diameter of the adjustable expansion device when the sensed operating pressure of the injected fluidic material exceeds a predetermined level within the second interior portion of the tubular support member.

38. The method of claim 37, further comprising:

pulling the adjustable expansion device through the expandable tubular member when the sensed operating pressure of the injected fluidic material exceeds a predetermined level within the first interior portion of the tubular support member.

39. The method of claim 38, wherein pulling the adjustable expansion device though the expandable tubular member comprises:

coupling one or more cup seals to the tubular support member above the adjustable expansion device;

pressuring the interior of the expandable tubular member below the cup seals; and pulling the adjustable expansion device though the expandable tubular member using the cup seals.

40. A system for radially expanding and plastically deforming an expandable tubular member, comprising:

means for supporting the expandable tubular member using a tubular support member and an adjustable expansion device;

means for injecting a fluidic material into the tubular support member;

means for sensing the operating pressure of the injected fluidic material within a first interior portion of the tubular support member;

means for displacing the adjustable expansion device relative to the expandable tubular member when the sensed operating pressure of the injected fluidic material exceeds a predetermined level within the first interior portion of the tubular support member;

means for sensing the operating pressure of the injected fluidic material within a second interior portion of the tubular support member; and means for reducing the outside diameter of the adjustable expansion device when the sensed operating pressure of the injected fluidic material exceeds a predetermined level within the second interior portion of the tubular support member.

41. The system of claim 40, further comprising:

means for pulling the adjustable expansion device through the expandable tubular member when the sensed operating pressure of the injected fluidic material exceeds a predetermined level within the first interior portion of the tubular support member.

42. The system of claim 41, wherein means for pulling the adjustable expansion device through the expandable tubular member comprises:

means for coupling one or more cup seals to the tubular support member above the adjustable expansion device;

means for pressuring the interior of the expandable tubular member below the cup seals; and means for pulling the adjustable expansion device through the expandable tubular member using the cup seals.

43. A collapsible expansion device, comprising:

an upper cam assembly comprising:

a tubular base; and a plurality of cam arms extending from the tubular base in a downward longitudinal direction, each cam arm defining an inclined surface;

a plurality of upper expansion segments interleaved with the cam arms of the upper cam assembly;

a lower cam assembly comprising:

a tubular base; and a plurality of cam arms extending from the tubular base in an upward longitudinal direction, each cam arm defining an inclined surface that mates with the inclined surface of a corresponding one of the upper expansion segments;

wherein the cams arms of the upper cam assembly are interleaved with and overlap the cam arms of the lower cam assembly;

a plurality of lower expansion segments interleaved with cam arms of the lower cam assembly, each lower expansion segment mating with the inclined surface of a corresponding one of the cam arms of the upper cam assembly;

means for moving the upper cam assembly away from the lower expansion segments; and means for moving the lower cam assembly away from the upper expansion segments.

44. The apparatus of claim 43, wherein the upper and lower expansion segments together define an arcuate spherical external surface.

45. The apparatus of claim 43, wherein each upper expansion segment comprises:

an inner portion defining an arcuate cylindrical upper surface and arcuate cylindrical lower surfaces;

an intermediate portion defining arcuate cylindrical and spherical upper surfaces and an arcuate conical lower surface; and an outer portion defining arcuate cylindrical upper and lower surfaces; and wherein each lower expansion segment comprises:

an inner portion defining an arcuate cylindrical upper surface and arcuate cylindrical lower surfaces;

an intermediate portion defining arcuate cylindrical and spherical upper surfaces and an arcuate conical lower surface; and an outer portion defining arcuate cylindrical upper and lower surfaces.

46. The apparatus of claim 43, wherein each upper expansion segment is tapered in the longitudinal direction from the intermediate portion to the outer portion; and wherein each lower expansion segment is tapered in the longitudinal direction from the intermediate portion to the outer portion.

* * * * *